US010954624B2

(12) United States Patent
Kim et al.

(10) Patent No.: US 10,954,624 B2
(45) Date of Patent: Mar. 23, 2021

(54) WASHING MACHINE

(71) Applicant: LG Electronics Inc., Seoul (KR)

(72) Inventors: Dongcheol Kim, Seoul (KR); Youngjong Kim, Seoul (KR); Youngjun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 158 days.

(21) Appl. No.: 16/083,097

(22) PCT Filed: Mar. 10, 2017

(86) PCT No.: PCT/KR2017/002622
§ 371 (c)(1),
(2) Date: Sep. 7, 2018

(87) PCT Pub. No.: WO2017/155352
PCT Pub. Date: Sep. 14, 2017

(65) Prior Publication Data

US 2019/0093277 A1 Mar. 28, 2019

(30) Foreign Application Priority Data

Mar. 10, 2016 (KR) ..... 10-2016-0028947
Mar. 10, 2016 (KR) ..... 10-2016-0028948

(51) Int. Cl.
*D06F 39/08* (2006.01)
*D06F 39/10* (2006.01)
(Continued)

(52) U.S. Cl.
CPC ..... *D06F 39/083* (2013.01); *D06F 37/24* (2013.01); *D06F 37/26* (2013.01); *D06F 39/08* (2013.01);
(Continued)

(58) Field of Classification Search
CPC ..... D06F 39/083; D06F 39/10; D06F 17/10; D06F 23/04; D06F 37/12; D06F 37/24; D06F 37/26; D06F 39/08
See application file for complete search history.

(56) References Cited

U.S. PATENT DOCUMENTS 5,509,283 A * 4/1996 Lee ..... D06F 17/06 68/18 F
5,661,989 A * 9/1997 Jeon ..... D06F 39/10 68/18 F
(Continued)

FOREIGN PATENT DOCUMENTS

JP S61197978 12/1986
JP H09313775 12/1997
(Continued)

OTHER PUBLICATIONS

KR 10-0441014 to Lee et al. (Year: 2004).*
(Continued)

*Primary Examiner* — Joseph L. Perrin
(74) *Attorney, Agent, or Firm* — Fish & Richardson P.C.

(57) ABSTRACT

Disclosed is a washing machine comprising: an outer tub which is disposed inside a cabinet and stores washing water; a sidewall member which is rotatably installed inside the outer tub and accommodates laundry therein; a tub base which is coupled to a lower end of the sidewall member and has a washing water inflow hole and a communication hole that are spaced apart from each other along a height direction; a guide member which is coupled to a bottom surface of the tub base and configured to communicate the washing water inflow hole and the communication hole in an outside of the tub base; and an upward flow path of washing water which extends along a height direction of the sidewall member and communicates with the guide member through the communication hole.

19 Claims, 28 Drawing Sheets

(51) Int. Cl.

| | |
|---|---|
| ***D06F 37/24*** | (2006.01) |
| ***D06F 37/26*** | (2006.01) |
| *D06F 37/40* | (2006.01) |
| *D06F 37/12* | (2006.01) |
| *D06F 17/10* | (2006.01) |
| *D06F 23/04* | (2006.01) |

(52) U.S. Cl.

CPC ..... *D06F 39/10* (2013.01); *D06F 17/10* (2013.01); *D06F 23/04* (2013.01); *D06F 37/12* (2013.01); *D06F 37/40* (2013.01); *D06F 39/088* (2013.01); *D06F 2222/00* (2013.01)

(56) References Cited

U.S. PATENT DOCUMENTS

| | | | | |
|---|---|---|---|---|
| 5,931,027 | A * | 8/1999 | Shin | D06F 39/10 68/18 F |
| 2008/0216520 | A1* | 9/2008 | Yoo | D06F 29/10 68/12.13 |
| 2008/0216523 | A1* | 9/2008 | Yoo | D06F 39/10 68/212 |
| 2009/0229318 | A1* | 9/2009 | Yoo | D06F 39/10 68/235 |
| 2009/0229319 | A1* | 9/2009 | Yoo | D06F 39/10 68/235 R |
| 2009/0235960 | A1* | 9/2009 | Yoo | D06F 37/12 134/110 |
| 2013/0036776 | A1* | 2/2013 | Seo | D06F 37/206 68/18 F |
| 2013/0139558 | A1* | 6/2013 | Kim | D06F 37/145 68/140 |
| 2014/0026624 | A1* | 1/2014 | Oh | D06F 39/08 68/18 F |
| 2014/0102154 | A1* | 4/2014 | Lee | D06F 39/083 68/18 F |

FOREIGN PATENT DOCUMENTS

| | | |
|---|---|---|
| JP | 2000014966 | 1/2000 |
| JP | 2009028509 | 2/2009 |
| KR | 100441014 | 7/2004 |
| KR | 101348718 | 1/2014 |

OTHER PUBLICATIONS

JP 2000-014966 to In et al. (Year: 2000).*

Australian Office Action in Australian Appln. No. 2017230177, dated Jan. 14, 2019, 3 pages.

* cited by examiner

WASHING MACHINE

CROSS-REFERENCE TO RELATED APPLICATIONS

This application is a National Stage application under 35 U.S.C. § 371 of International Application No. PCT/KR2017/002622, filed on Mar. 10, 2017, which claims the benefit of Korean Application No. 10-2016-0028948, filed on Mar. 10, 2016, and Korean Application No. 10-2016-0028947, filed on Mar. 10, 2016. The disclosures of the prior applications are incorporated by reference in their entirety.

TECHNICAL FIELD

The present invention relates to a washing machine having a rising flow path of washing water.

BACKGROUND ART

Generally, a top loading washing machine refers to a washing machine in which an opening is formed in an upper part of an inner tub, and laundry is loaded and unloaded through the opening. The most common form of the top loading washing machine is a pulsator type washing machine.

In a pulsator-type washing machine, in a state in which the laundry is put in the inner tub, laundry is washed by the water flow of washing water generated by forcibly flowing the washing water by the rotation of a pulsator installed in the lower part of the inner tub, and the emulsifying action of the detergent. The pulsator is rotated by a driving motor and can form various types of water flow inside a washing tub through forward and reverse rotation.

Meanwhile, the prior art related to the present invention (disclosed in Korean Patent Application Laid-Open No. 2003-0049818, published on Jun. 25, 2003) discloses an impeller which is rotatably installed at a lower portion of a washing tub so that the washing water staying in a space between a washing tub (which may be referred to as a an inner tub) and an outer tub can be pumped. The washing water pumped by the impeller rises through a water flow guide plate and is supplied again into the washing tub through a pumping water discharge hole.

In the prior art, as the water flow guide plate mounted on the inner side of the washing tub extends to the lower portion of a washing plate forming the bottom surface of the washing tub, there is a problem that the inner bottom structure of the washing tub occupies a considerable volume. In addition, in the prior art, the washing plate is configured to move up and down. When the washing plate is moved up and down or rotated, there is a problem that it interferes with the lower structure of the water flow guide plate. If the washing plate is made smaller in size to prevent such interference, there is a problem that the lower end portion of the water flow guide plate is exposed or a separate structure is required to cover such a exposing.

When the water flow guide plate is mounted on the inner side of the washing tub, there is a problem that when a user sees the inside of the inner tub, an unpleasant aesthetic feeling may occur. In addition, if the water flow guide plate is formed of a member separate from the washing tub, there is a problem that foreign substances generated in the washing tub or cloths are caught between the water flow guide plate and the washing tub.

In addition, in the prior art, as the pumping water discharge hole is formed in the middle of the water flow guide plate, the cloth wetting effect is negligible. When a filter is provided in the pumping water discharge hole, there is a problem that user has to bend his/her back a lot in order to remove the foreign matter accumulated in the filter.

Further, in the above-mentioned prior art, a power transmitting means is configured to reduce the rotational speed of a driving motor to drive the washing plate to transmit the reduced rotational speed to the impeller, so that the pumping pressure by the impeller is low. Thus, there is a problem that it is difficult to actually discharge the washing water by the pumping water discharge hole provided in an upper side of the water flow guide plate. In the prior art, the pumping water discharge hole is formed in the middle of the water flow guide plate based on the above mentioned problem. In addition, since the most of the washing water is discharged through the pumping water discharge hole disposed in the middle of the water flow guide plate, there is a problem that the amount of washing water which is discharged through the pumping water discharge hole disposed in the upper side of the water flow guide plate and dropped with a large fall head is further reduced.

In addition, in the prior art, the pumping water of the washing water formed by the rotation of the impeller has a directionality corresponding to the rotating direction of the impeller. Accordingly, a considerable amount of the washing water may form a vortex and stay at the bottom of the water flow guide plate, or may pass through a lower portion of the water flow guide plate, so that the washing water cannot flow smoothly into a guide flow path inside the water flow guide plate.

DISCLOSURE

Technical Problem

An object of the present invention is to solve the problems of the prior art.

A first object of the present invention is to provide a flow path for a rising of washing water which is convenient in the assembly and manufacturing process and is excellent and efficient in function.

A second object of the present invention is to provide a washing machine in which the inner lower portion of an inner tub can be configured more simply.

A third object of the present invention is to provide a washing machine which can improve the cloth wetting effect and which allows a user to easily access a filter unit.

A fourth object of the present invention is to provide a washing machine which allows a larger amount of washing water to be introduced into the rising flow path of the washing water and has an improved rotational force of a pulsator.

Technical Solution

In an aspect, there is provided a washing machine, including: an outer tub which is disposed inside a cabinet and stores washing water; a sidewall member which is rotatably installed inside the outer tub and accommodates laundry therein; a tub base which is coupled to a lower end of the sidewall member and has a washing water inflow hole and a communication hole that are spaced apart from each other along a height direction; a guide member which is coupled to a bottom surface of the tub base and configured to communicate the washing water inflow hole and the communication hole in an outside of the tub base; and an upward flow path of washing water which extends along a height direction of the sidewall member and communicates with the guide member through the communication hole.

The guide member includes: a washing water inlet port which communicates with the washing water inflow hole; and a washing water outlet port which is provided in a position spaced apart from the washing water inlet port and communicates with the communication hole.

The guide member includes a partition wall extending from the washing water inlet port toward the washing water outlet port so as to guide an inflow of the washing water.

The member is disposed to cover a bottom surface of the tub base.

The guide member is provided with an engaging hook engageable with the communication hole.

A protruding portion is provided on a bottom surface of the tub base, and the guide member is provided with a surround portion configured to surround the protruding portion.

The washing machine further includes a hub which has a water inflow hole and is coupled to the bottom surface of the tub base to cover a part of the surround portion.

The washing machine further includes a pulsator which is rotatably provided in the tub base, and forms a water flow of washing water during rotation; and a blade which is rotatably provided in a lower portion of the pulsator to form a pumping water flow for transferring washing water to the washing water inflow hole during rotation.

The washing machine further includes a filter unit which communicates with an upper end of the upward flow path and discharges the washing water filtered foreign matter into the inside of the sidewall member.

The filter unit includes: a filter housing which is mounted in an upper opening to communicate with the upward flow path and has an opening portion opened toward the inside of the sidewall member; and a filter which is mounted in the filter housing to cover the opening portion, and includes a mesh filter for filtering foreign matter contained in the washing water and discharge holes for discharging the washing water filtered the foreign matter.

The washing machine further includes a duct cover which is mounted in an inner side of the sidewall member to form the upward flow path together with the sidewall member.

The duct cover includes: a cover recess portion which extends along a height direction and is disposed to cover an upper surface of the tub base and an inner surface of the sidewall member; and a rib portion which extends along both sides of the cover recess portion, and defines the cover recess portion.

The rib portion is provided with a engaging hook engageable with an engagement hole of the sidewall member.

A guide rib extending from both sides of the duct cover along a height direction of the sidewall member is protruded from the inside of the sidewall member.

The sidewall member is provided with a sidewall recess portion having a shape recessed from the outside to the inside along a height direction of the sidewall member, and a duct cover is mounted in the outer side of the sidewall member so as to cover the recessed portion of the sidewall recess portion to form the upward flow path together with the recessed portion.

The sidewall recess portion is formed in a shape in which at least a part of the sidewall member is bent by forming.

The sidewall recess portion is protruded to the inside of the sidewall member.

The duct cover is formed in a round shape to correspond to the sidewall member.

A lower end of the sidewall recess portion covers an upper surface of the tub base around the communication hole.

The sidewall member is provided with a sidewall recess portion having a shape recessed from the outside to the inside along a height direction of the sidewall member, a duct cover is mounted in the outer side of the sidewall member so as to cover the recessed portion of the sidewall recess portion to form the upward flow path together with the recessed portion, and the duct cover is mounted to cover the filter housing mounted in the upper opening.

Advantageous Effects

The washing water pumped by the blade flows into the guide member and moves from the washing water inflow hole to the communication hole. At this time, the flow of the washing water is achieved outside the tub base. Thereafter, the washing water is moved to the upper side of the sidewall member through the upward flow path of washing water. At this time, the washing water flows inside the tub base and inside the sidewall member. As described above, according to the present invention, a new flow path structure in which the flow path for raising the washing water pumped by the blade is changed from the outside of the tub base to the inside can be implemented.

In addition, since the blade is accommodated in the first portion of the tub base, and the fixing jig and the pulsator are configured to be accommodated in a second portion upwardly outwardly stepped with respect to the first portion, a cover for covering the fixing jig is unnecessary. Therefore, the inner lower portion of the inner tub can be more simply configured, the manufacturing cost can be reduced, and the assembling process can be simplified.

Further, since the filter unit is mounted in the upper end of the duct cover, the filtered washing water can be dropped from a higher position, and can be discharged in a larger area in the sidewall member. Therefore, the cloth wetting effect can be improved.

Further, since the filter unit is positioned adjacent to the door that opens and closes the upper opening of the inner tub, with this arrangement, user can easily access the filter unit without bending without bending the waist too much. Therefore, the user can easily remove the foreign matter accumulated in the filter unit 137

In addition, since the power transmitted from the driving motor is transmitted to the blade without deceleration, the pumping water flow due to the rotation of the blade can be increased, and as the planetary gear module is provided between the blade and the pulsator, the pulsator is rotated at a higher torque than the blade while being slower than the blade, so that the efficient operation of the driving motor can be achieved.

In addition, a partition wall is formed to extend from the washing water inlet port toward the washing water outlet port in the guide member coupled to the bottom surface of the tub base, thereby guiding the inflow of the washing water into the guide member. Therefore, a larger amount of washing water can be introduced into the upward flow path of the washing water.

Further, since the sidewall recess portion, which is recessed from the outside of the sidewall member to the inside, is formed to extend along the height direction of the sidewall member, and the duct cover is mounted in the outer side of the sidewall member so as to cover the recessed portion of the sidewall recess portion to form the upward flow path of the washing water, there is no need for a separate duct member provided inside the sidewall member in order to form the upward flow path of washing water in the related art. Therefore, the inside of the sidewall member can be implemented more simply, and more hygienic washing can be achieved as the sidewall member is formed of a single metal material (e.g., stainless steel). In addition, there is an effect that the cloth or foreign matter in the inner tub is not caught in a gap between the duct cover and the sidewall member.

DESCRIPTION OF DRAWINGS

FIG. 5 shows a state in which the guide member 136 is coupled to the tub base 133 without the hub 134, and FIG. 6 shows a state in which the hub 134 is coupled to the tub base 133 of FIG. 5.

FIG. 7 is an exploded perspective view of the fixing jig 190, the tub base 133, and the guide member 136. FIG. 8 is a vertical cross-sectional view of a portion where a jig fastening member 191 is disposed in a state in which the fixing jig 190, the tub base 133, and the guide member 136 are assembled.

FIG. 22 is a perspective view of the sidewall member 2131 with the filter unit 137 and the duct cover 2135 separated from each other. FIG. 23 is a perspective view showing a state in which the filter unit 137 is coupled to the sidewall member 2131 of FIG. 22. FIG. 24 is a perspective view showing a state in which the duct cover 2135 is coupled to the sidewall member 2131 of FIG. 23. FIG. 25 is an enlarged partial perspective view of an upper portion of the duct cover 2135 of FIG. 24, and FIG. 26 is an enlarged partial perspective view of a lower portion of the duct cover 2135 of FIG. 24.

MODE FOR INVENTION

Figure 1:
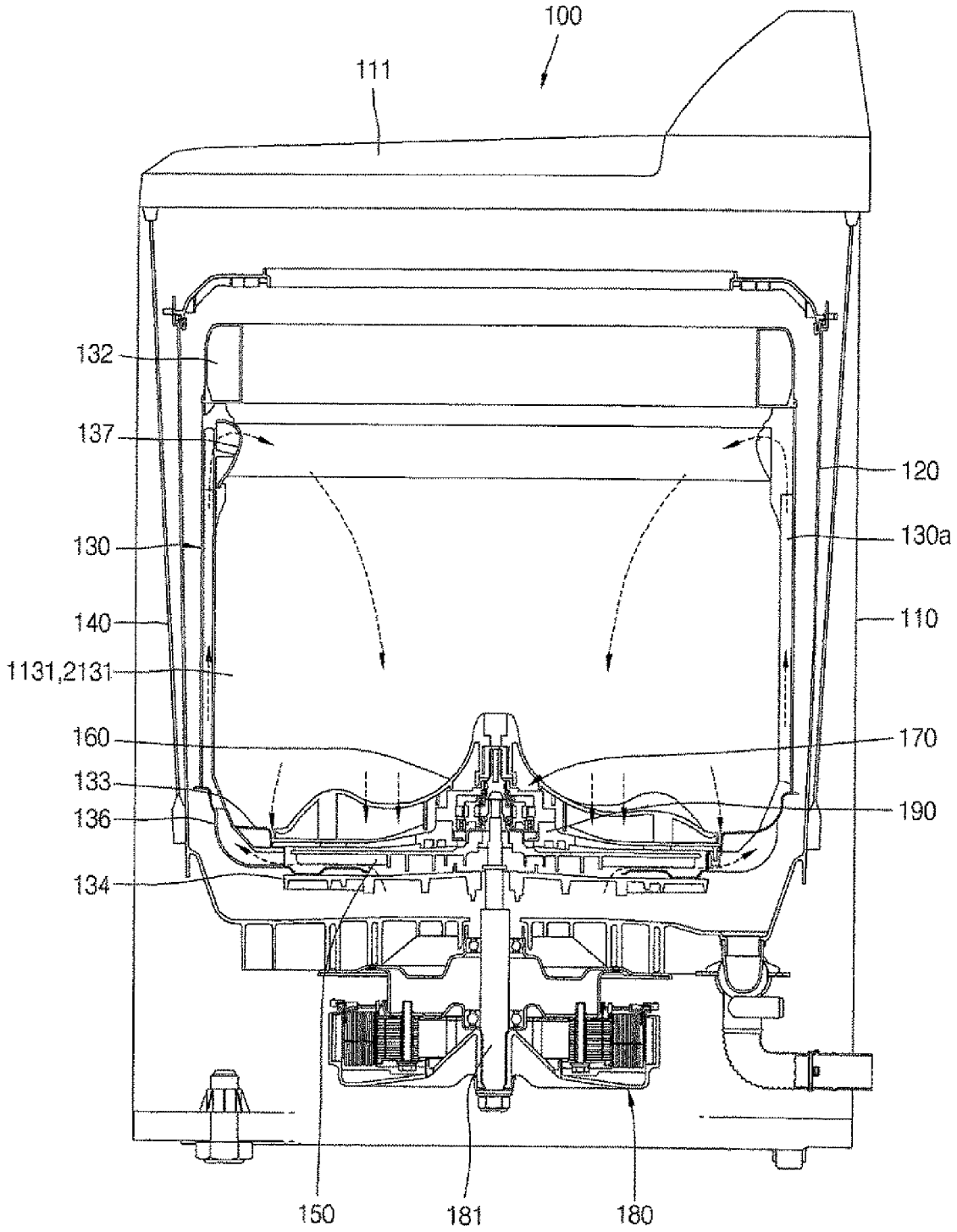
FIG. 1 is a vertical cross-sectional view of a washing machine 100 according to an embodiment (first and second embodiments) of the present invention.
Figure 2A:
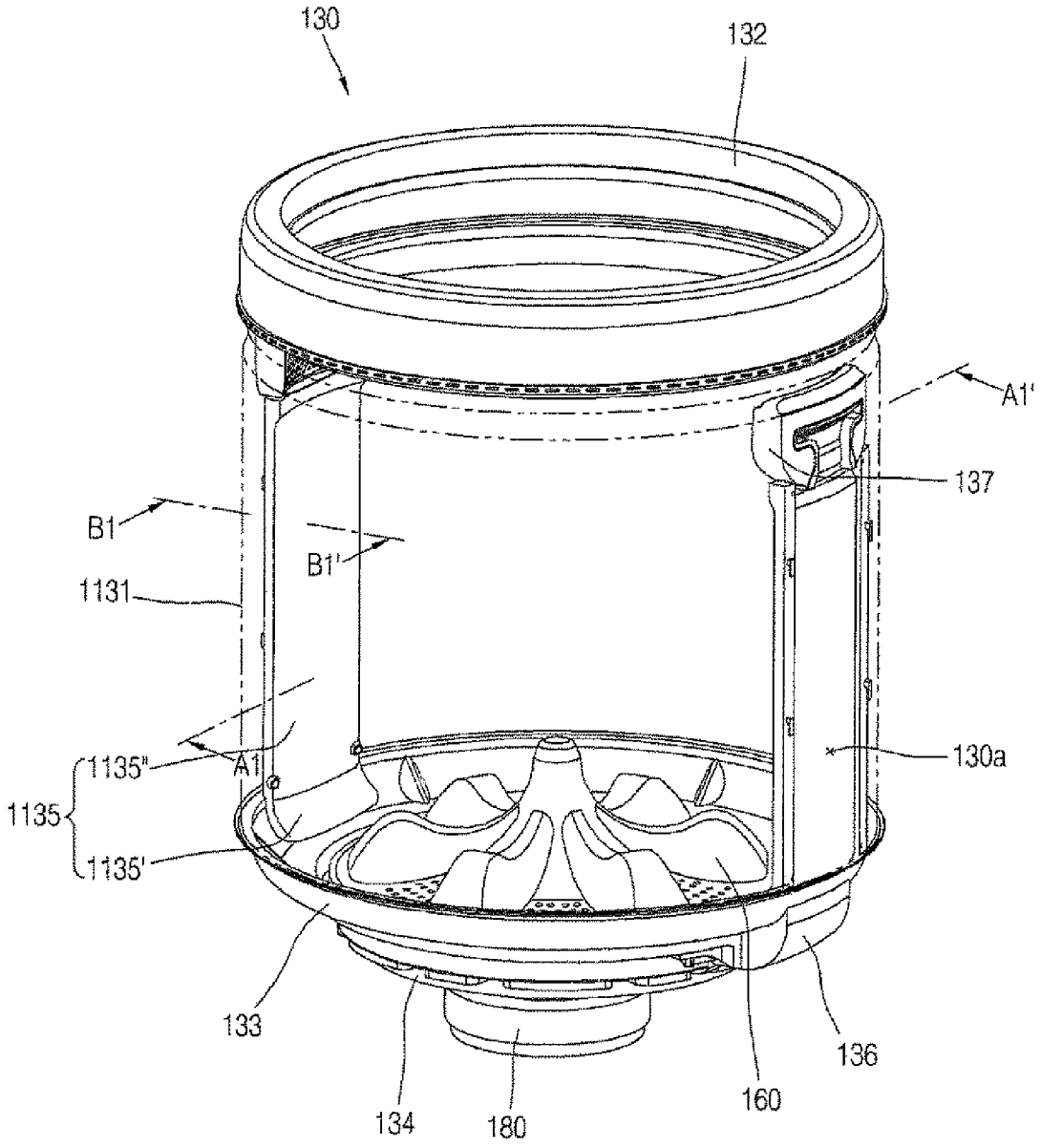
FIG. 2A is a perspective view showing internal configurations of the washing machine 100 shown in FIG. 1 according to a first embodiment of the present invention.
Figure 2B:
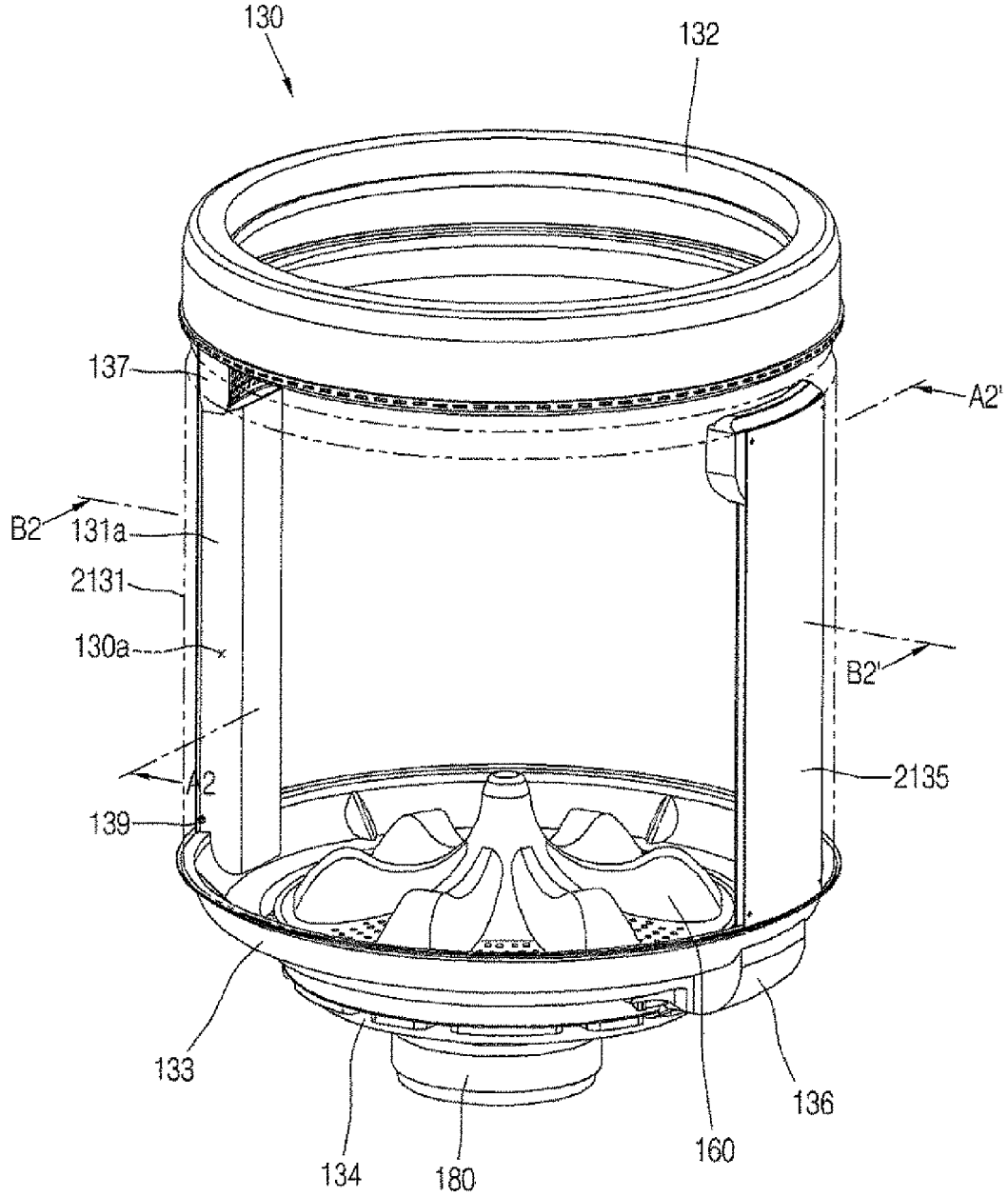
FIG. 2B is a conceptual view showing internal configurations of the washing machine 100 shown in FIG. 1 according to a second embodiment.
Figure 3A:
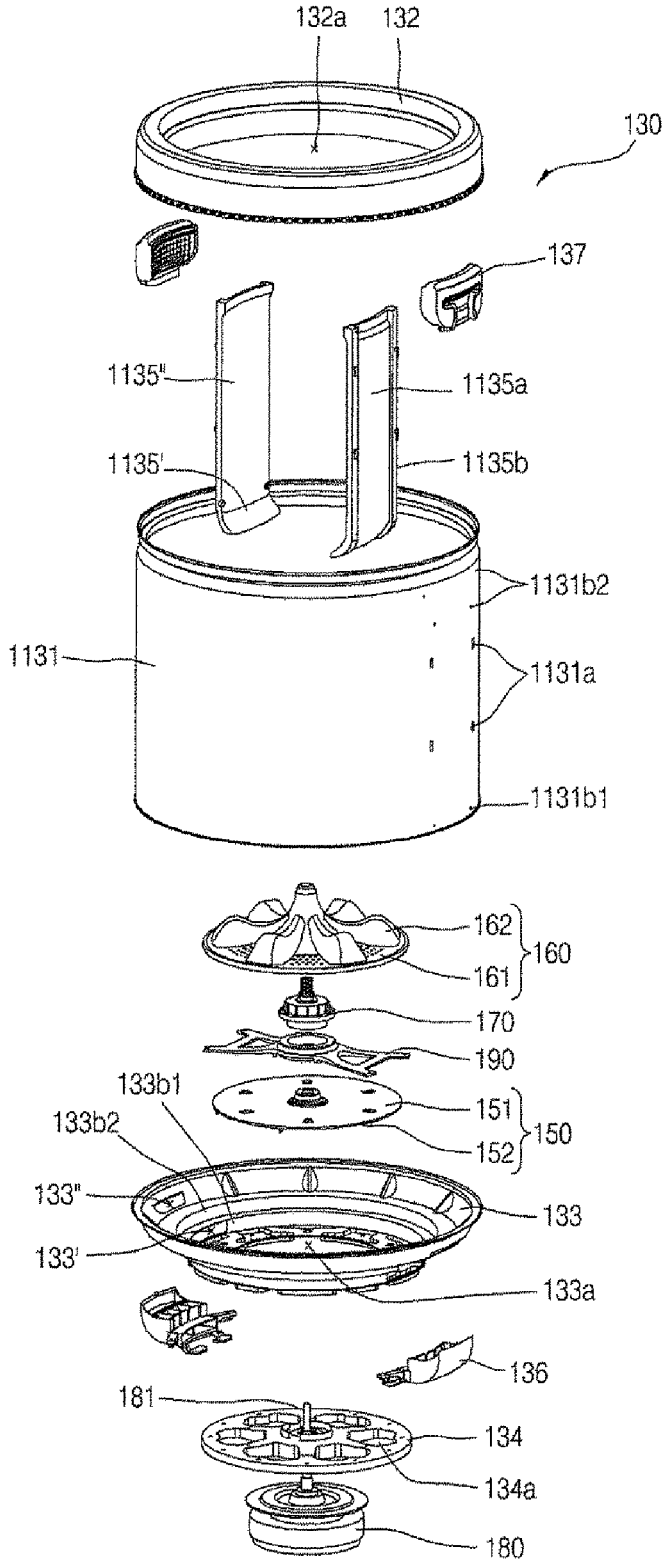
FIG. 3A is an exploded perspective view of the washing machine 100 according to the first embodiment shown in FIG. 2A.
Figure 3B:
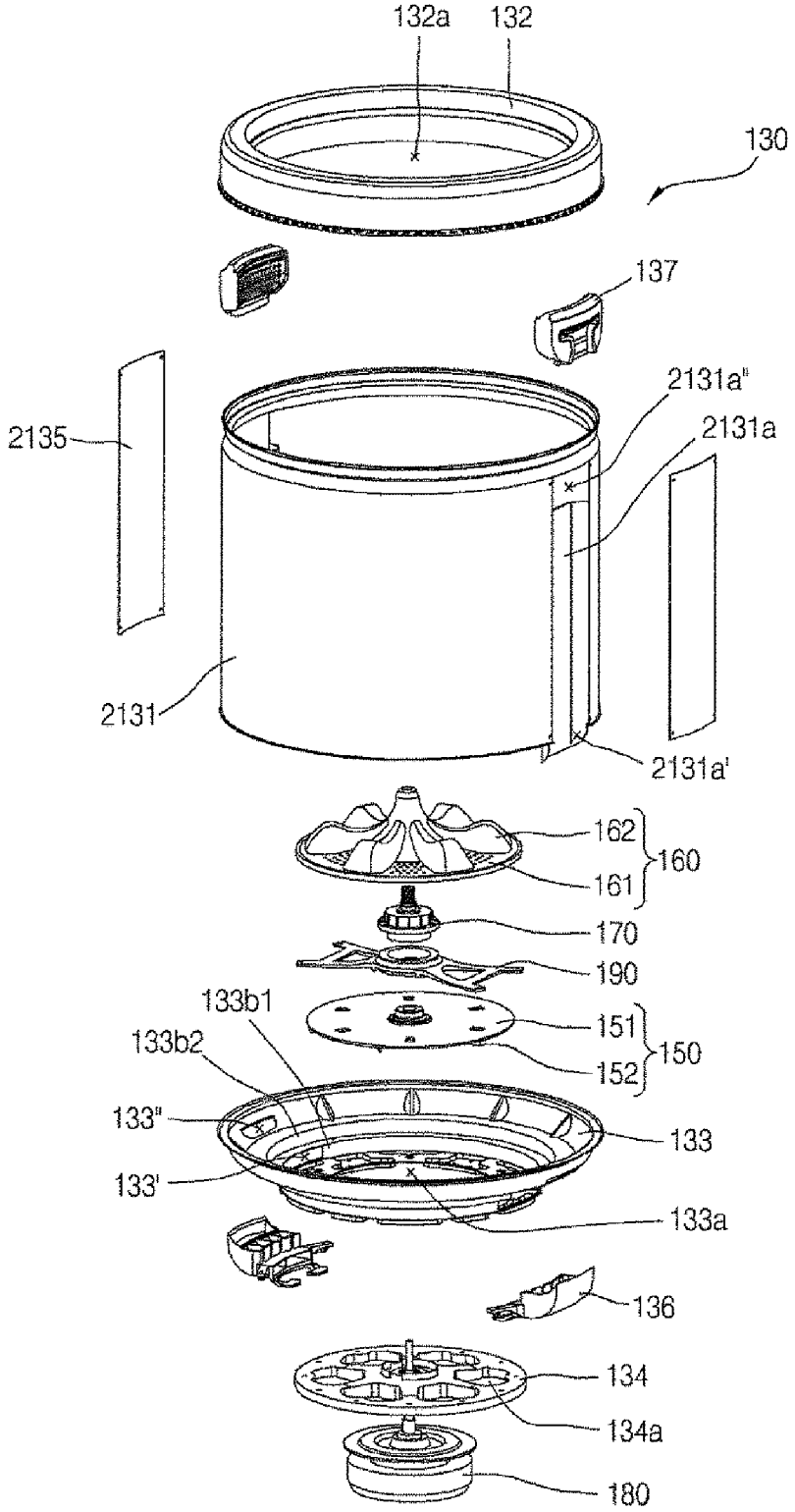
FIG. 3B is an exploded perspective view of the washing machine 100 according to the second embodiment shown in FIG. 2B.

As used herein, the singular forms "a", "an" and "the" include plural referents unless the context clearly dictates otherwise. A washing machine 100 according to an embodiment of the present invention is roughly divided into a washing machine 100 according to a first embodiment and a washing machine 100 according to a second embodiment.

FIG. 1 and FIGS. 4 to 9 are common views of the first and second embodiments. FIG. 2A, FIG. 3A and FIG. 10 to FIG. 16 are views of the first embodiment, FIG. 2B, FIG. 3B and FIG. 17 to FIG. 26 are views of the second embodiment. The configurations differing from each other in the first embodiment and the second embodiment are a sidewall member 1131, 2131 and a duct cover 1135, 2135, and the reference numerals of the configurations related thereto are indicated differently from each other. In the first embodiment and the second embodiment, the same reference numerals denote the same components.

Referring to FIGS. 1 to 3B, the washing machine 100 according to the present embodiment (first and second embodiments) includes a cabinet 110 forming an outer shape. The washing machine 100 includes an outer tub 120 disposed inside the cabinet 110 to store washing water. The washing machine 100 includes an inner tub 130 rotatably installed inside the outer tub 120.

The cabinet 110 forms an opening communicating with a laundry storage space in the inner tub 130. The cabinet 110 includes a door 111 for opening and closing the opening. In FIG. 1, the door 111 is provided in an upper portion of the cabinet 110.

The outer tub 120 is configured to have a tubular shape with an opened one side corresponding to the opening of the cabinet 110. The washing water supplied from a washing water supply unit is stored in the outer tub 120. The detergent supplied from the detergent supply unit is dissolved in the washing water.

As shown in the drawing, the outer tub 120 can be supported by a suspension bar 140 installed inside the cabinet 110.

The inner tub 130 has a laundry storage space for accommodating laundry therein. The inner tub 130 is configured to be rotatable by receiving power from a driving motor 180.

The inner tub 130 selectively receives power from the driving motor 180 by a clutch, fixed during washing and rinsing, and rotated during spin-dry.

The inner tub 130 includes a sidewall member 1131, 2131. The inner tub 130 includes a balancer 132 mounted on an upper end of the sidewall member 1131, 2131. The inner tub 130 includes a tub base 133 coupled to a lower end of the sidewall member 1131, 2131. The inner tub 130 includes a hub 134 coupled to a bottom surface of the tub base 133. The washing water stored in the outer tub 120 flows into the inner tub 130 through a water inflow hole 134*a* of the hub 134 and an opening 133*a* of the tub base 133.

The sidewall member 1131, 2131 is formed in a cylindrical shape with opened upper and lower sides. The sidewall member 1131, 2131 is provided with a plurality of dewatering holes (not shown) to allow the washing water to escape during spin-dry. The sidewall member 1131, 2131 is formed of a metal material, and may preferably be formed of stainless steel to prevent corrosion and bacterial growth.

The balancer 132 is coupled to the upper end of the sidewall member 1131, 2131 to reduce vibration due to eccentric rotation of the inner tub 130 containing the laundry. The balancer 132 can be coupled with the sidewall member 1131, 2131 by curling or volting. The balancer 132 has a circular ring shape corresponding to the sidewall member 1131, 2131 and has a hollow portion 132*a* corresponding to the inner space of the sidewall member 1131, 2131.

The balancer 132 is filled with a certain amount of fluid. For example, the fluid may be filled in the balancer 132 at a rate of about 40% to 70% of the inner volume of the balancer 132, and the fluid may be brine.

When the laundry rotates eccentrically to one side of the inner tub 130, the fluid filled in the balancer 132 moves to the other side which is the opposite side of the one side. Thus, the vibration of the inner tub 130 caused by the eccentricity of the laundry can be reduced.

The tub base 133 is coupled to the lower end of the sidewall member 1131, 2131. The tub base 133 may be coupled to the sidewall member 1131, 2131 by curling or welding. The tub base 133 is formed in a circular ring shape having an opening 133*a* formed therein. The opening 133*a* communicates with the water inflow hole 134*a* of the hub 134 so that the washing water stored in the outer tub 120 can be introduced.

The hub 134 connected to the driving motor 180 is coupled to the bottom surface of the tub base 133. The inner tub 130 receives the power of the driving motor 180 through the hub 134 and is rotated. The hub 134 is provided with the water inflow hole 134*a*.

A blade 150 and a pulsator 160 are provided at a lower portion of the inner tub 130, and are selectively rotatable by receiving power from the driving motor 180. The pulsator 160 is disposed on the blade 150 to cover the blade 150. The tub base 133 has a first portion 133*b*1 and a second portion 133*b*2 that accommodate the blade 150 and the pulsator 160, respectively. The second portion 133*b*2 has an upwardly outwardly stepped shape with respect to the first portion 133*b*1.

A washing water inflow hole 133' is formed in the first portion 133*b*1 of the tub base 133, and a communication hole 133" is formed in the upper portion of the second portion 133*b*2. A guide member 136 for connecting the washing water inflow hole 133' and the communication hole 133" is mounted on the bottom surface.

The blade 150 is configured to be rotatable within the first portion 133*b*1, and includes a rotating plate 151 and a pumping wing 152 protruding from the bottom surface of the rotating plate 151. The rotating plate 151 is connected to the driving motor 180 to receive the power, and the pumping wing 152 forms a pumping water flow that moves the washing water filled in the lower portion of the rotating plate 151 to the washing water inflow hole 133' when the rotating plate 151 rotates. The pumping wing 152 may extend radially from the center of the rotating plate 151.

The pulsator 160 is configured to be rotatable within the second portion 133*b*2. The pulsator 160 together with the tub base 133 forms a bottom portion in which laundry is contained. The pulsator 160 has a rotating plate 161 configured to be rotatable by receiving a rotational force from a planetary gear module 170 and a protrusion 162 extending radially on the rotating plate 161. The pulsator 160 receives power from the driving motor 180 and rotates in the forward and/or reverse direction, thereby forming a rotating water flow. The laundry can be washed by the rotating water flow in such a manner that the laundry is scrubbed to be washed.

Both the blade 150 and the pulsator 160 are rotated by directly or indirectly receiving the power by the driving motor 180. Since the pulsator 160 is configured to stir the washing water and the laundry, the rotational load applied to the pulsator 160 is relatively larger than that of the blade 150 so that the driving motor 180 may be overloaded when the power of the driving motor 180 is entirely transmitted to the pulsator 160.

A planetary gear module 170 is provided between the blade 150 and the pulsator 160 to adjust the rotation ratio of the pulsator 160 to the blade 150. The planetary gear module 170 decelerates the rotational speed of the driving motor 180 to transmit the power of the driving motor 180 to the pulsator 160. Accordingly, the pulsator 160 can be rotated at a higher torque than the blade 150.

The planetary gear module 170 is fixedly positioned on the axis of the driving motor 180 by the fixing jig 190. The fixing jig 190 is configured to surround and fix the planetary gear module 170, and is radially extended to be coupled to the tub base 133. A jig fastening member 191 may be fastened to the guide member 136 while passing through the fastening jig 190 and the tub base 133.

Meanwhile, the washing machine 100 of the present invention includes an upward flow path 130*a* for raising the washing water pumped by the blade.

Figure 4:
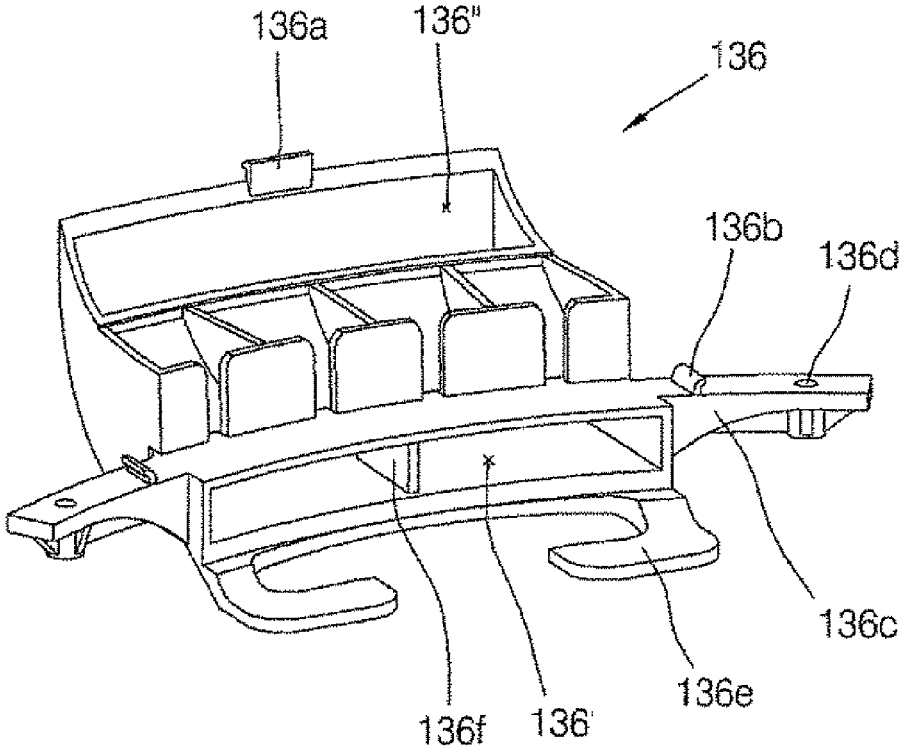
FIG. 4 is a perspective view showing a guide member 136 of FIG. 3A and FIG. 3B.

Referring to FIG. 4, the guide member 136 guides the pumping water flow formed by the rotation of the blade 150 to the upward flow path 130*a* of the washing water. The guide member 136 is configured to communicate the washing water inflow hole 133' formed in the tub base 133 with the communication hole 133" each other in the outside of the tub base 133.

The guide member 136 has a washing water inlet port 136' communicating with the washing water inflow hole 133'. The guide member 136 has a washing water outlet port 136" communicating with the communication hole 133". The guide member 136 has the washing water inlet port 136' and the washing water outlet port 136" which communicate with the washing water inflow hole 133' and the communication hole 133" respectively. The washing water inlet port 136' and the washing water outlet port 136' are spaced apart from each other. The washing water inlet port 136' and the washing water outlet port 136' are formed to communicate with each other. Referring to FIGS. 4 to 7, one end of the guide member 136 having the washing water inlet port 136' is disposed in the washing water inflow hole 133'. The other end of the guide member 136 provided with the washing water outlet port 136" is disposed to cover the communication hole 133".

Figure 5:
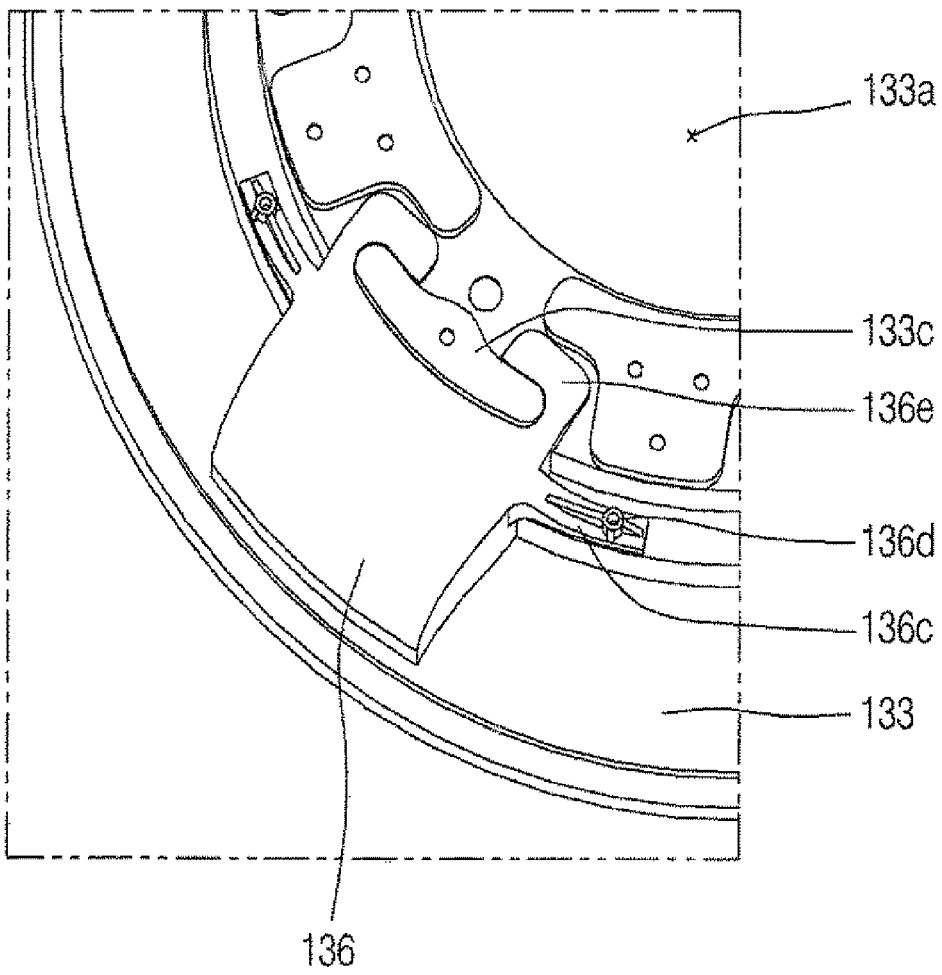
FIG. 5 and FIG. 6 are partial perspective views showing a coupling process of the guide member 136 and the hub 134 with respect to a tub base 133 shown in FIGS. 3A and 3B.
Figure 6:
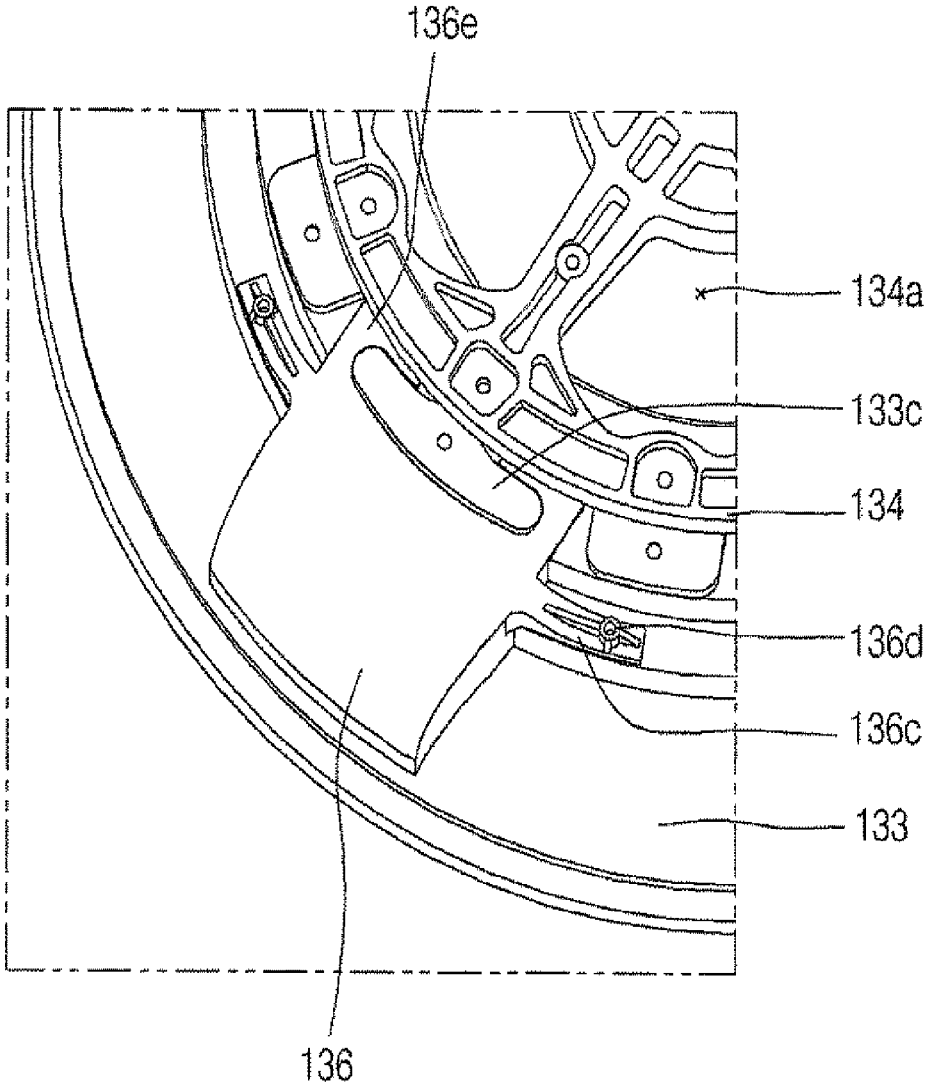

Referring to FIG. 4 to FIG. 6, the guide member 136 can be fixed to the tub base 133 by hook coupling. An engaging hook 136*a* is formed in the other end of the guide member 136 provided with the washing water outlet port 136". The engaging hook 136*a* is able to be engaged with the communication hole 133". The washing water outlet port 136" is disposed to face the inlet (lower end) of the upward flow path 130*a* while the communication hole 133" is positioned therebetween. The upward flow path 130*a* is formed by the sidewall member 1131, 2131 and the duct cover 1135, 2135.

Together with or separately from the engaging hook 136*a*, the guide member 136 may be provided with a fixing hook 136*b* capable of engaging with an engaging portion (not shown) formed on the bottom surface of the tub base 133.

The guide member 136 has an extension portion 136*c* that extends to both sides of the guide member 136. The extension portion 136*c* may be provided with a fastening groove 136*d* for fixing the jig fastening member. The above mentioned fixing hook 136*b* may be provided in the extension portion 136*c*.

The pumping water flow of the washing water formed by the rotation of the blade 150 has a directionality corresponding to the rotating direction of the blade 150. Accordingly, a considerable amount of the washing water forms a vortex and stays around the washing water inlet port 136', or passes through the washing water inlet port 136', so that it cannot flow into the guide member 136.

In order to solve this problem, the guide member 136 may be provided with a partition wall 136*f* extending from the washing water inlet port 136' to the washing water outlet port 136". The partition wall 136*f* guides the inflow of the washing water so that a larger amount of wash water can be introduced into the guide member 136.

The partition wall 136*f* may be positioned at the center of the washing water inlet port 136'. In this case, the washing water flows into the spaces in both sides of the partition wall 136*f* substantially equally, and the washing water flowing out through the washing water outlet port 136" can be evenly discharged over the entire area without being biased toward one side.

Hereinafter, the coupling process of the guide member 136 and the hub 134 with respect to the tub base 133 will be described with reference to FIGS. 5 and 6.

First, referring to FIG. 5 together with FIG. 4, a guide member 136 is mounted on the bottom surface of the tub base 133. The guide member 136 is mounted in a preset position on the bottom surface of the tub base 133 so that the washing water inflow hole 133' and the communication hole 133" are communicated with each other in the outside of the tub base 133. To this end, a protrusion 133*c* is provided on the bottom surface of the tub base 133 and a surround portion 136*e* surrounding the protrusion 133*c* is provided in the guide member 136. The surround portion 136*e* may extend from both sides of the washing water inlet port 136' respectively.

The surround portion 136*e* may be configured such that portions extending from both sides of the washing water inlet port 136' are not mutually connected to each other so as to enclose a part of the protrusion 133*c*, or portions extending from both sides of the washing water inlet port 136' are mutually coupled to each other so as to completely enclose the protrusion 133*c*.

As the surround portion 136*e* is formed to surround the protrusion 133*c*, the mounting position of the guide member 136 with respect to the tub base 133 can be determined. In addition, when the guide member 136 is mounted in the tub base 133, the fixing hook 136*b* can be engaged with the bottom surface of the tub base 133, and the engaging hook 136*a* can be engaged with the communication hole 133". Through such a fixing structure, the guide member 136 can be mounted in a preset position of the tub base 133.

Referring to FIG. 6, the hub 134 may be mounted on the bottom surface of the tub base 133 in the state in which the guide member 136 is mounted on the bottom surface of the tub base 133. The hub 134 is formed of a circular member having a certain thickness. The hub 134 is mounted in the tub base 133. As the hub 134 is mounted in the tub base 133, the overall rigidity of the inner tub 130 can be improved. The hub 134 is engaged a the rotary shaft 181 of the driving motor 180. The hub 134 transfers the power generated by the driving motor 180 to the inner tub 130.

The hub 134 is provided with the water inflow hole 134*a* communicating with the opening 133*a* of the tub base 133. The washing water stored in the outer tub 120 flows into the inner tub 130 through the water inflow hole 134*a* of the hub 134 and the opening 133*a* of the tub base 133. A plurality of water inflow holes 134*a* may be formed to be spaced apart from each other along the circumferential direction of the hub 134. In the present embodiment, although it is shown that the water inflow hole 134*a* has a fan shape, the shape of the water inflow hole is not limited thereto.

The hub 134 is disposed to cover a part of the guide member 136 when it is mounted on the bottom surface of the tub base 133. In this drawing, it is shown that a part of the surround portion 136*e* is covered with the hub 134. With this mounting structure, the movement of the guide member 136 in the vertical direction can be restricted, so that a more rigid fixing structure of the guide member 136 can be implemented.

Figure 7:
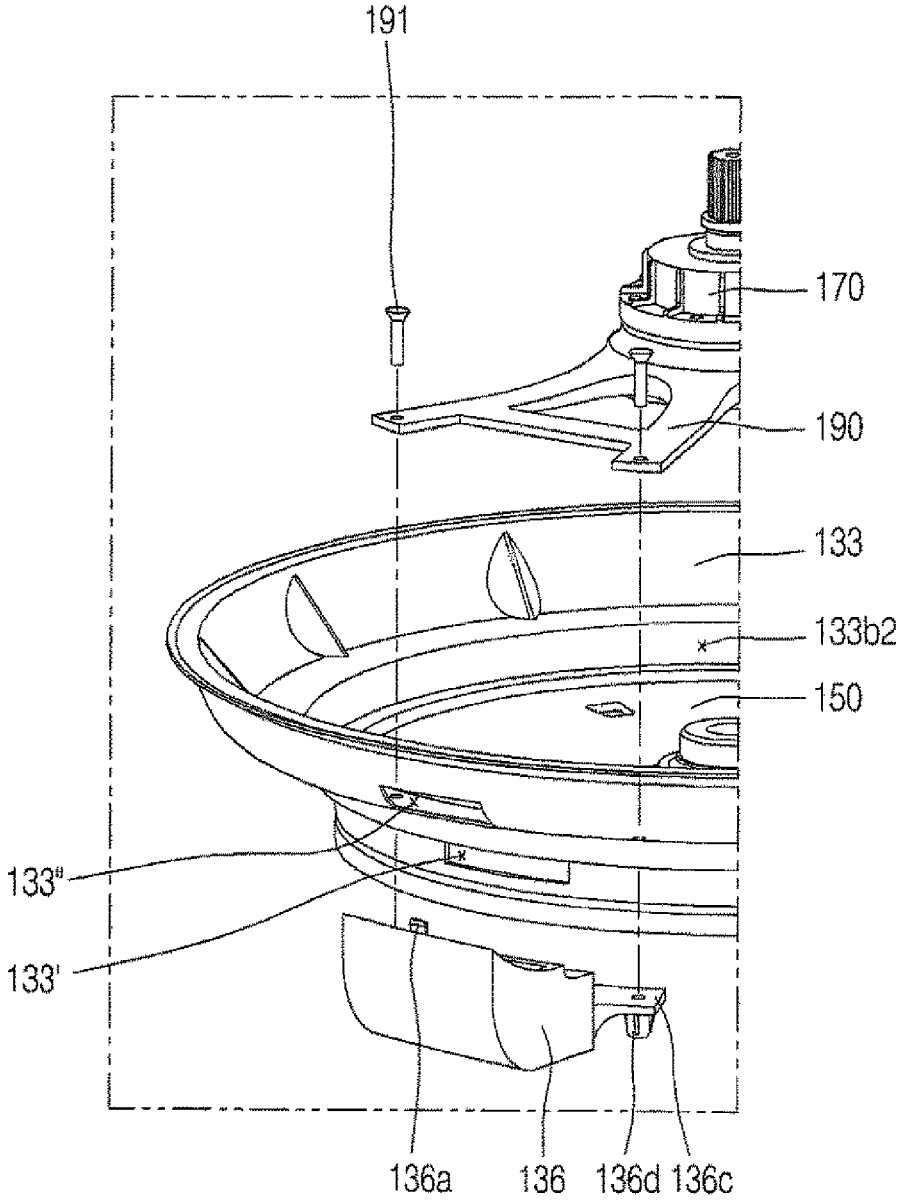
FIG. 7 and FIG. 8 are views showing a coupling structure between a fixing jig 190, the tub base 133, and the guide member 136 shown in FIG. 3A and FIG. 3B.
Figure 8:
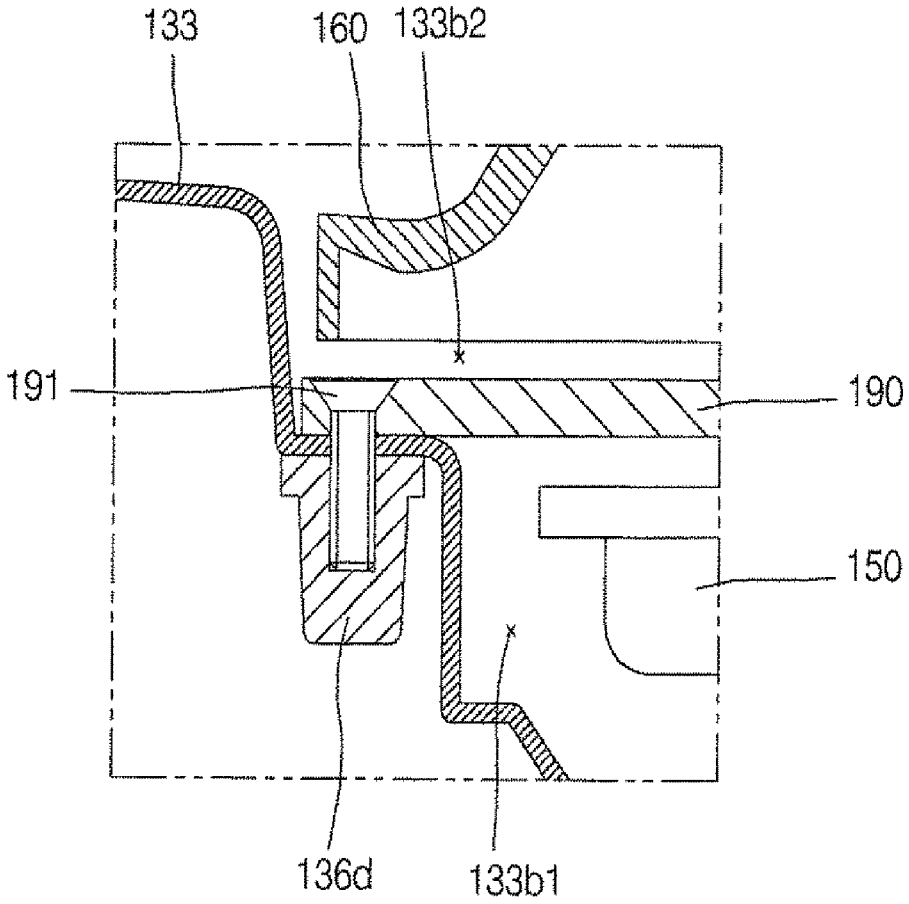

Referring to FIGS. 7 and 8, the fixing jig 190 for fixing the position of the planetary gear module 170 is provided between the pulsator 160 and the blade 150. The fixing jig 190 extends radially and is coupled to the tub base 133.

When the fixing jig 190 is configured to more protrude radially than the pulsator 160, a cover for covering the fixing jig 190 is required. However, in the present invention, since the tub base 133 is formed in a stepped shape and the fixing jig 190 and the pulsator 160 are accommodated in the stepped recessed portion, a separate cover excluding the pulsator 160 for covering the fixing jig 190 is unnecessary.

Specifically, as described above, the tub base 133 is provided with a first portion 133*b*1 and a second portion 133*b*2 which are stepped in two stages. The second portion 133*b*2 is positioned on the first portion 133*b*1, and the second portion 133*b*2 has a shape which is stepped upwardly outwardly with respect to the first portion 133*b*1. The blade 150 is accommodated in the first portion 133*b*1. The fixing jig 190 and the pulsator 160 are accommodated in the second portion 133*b*2. Meanwhile, the guide member 136 is disposed to cover the bottom surface of the tub base 133.

The fixing jig 190 is fixed to the bottom surface of the second portion 133*b*2. To this end, the jig fastening member 191 may be fastened to the guide member 136 while passing through the fixing jig 190 and the bottom surface of the second portion 133*b*2. The jig fastening member 191 can be fastened to the fastening groove 136*d* provided in the extension portion 136*c*. The fixing jig 190 and the guide member 136 can be fixed to the tub base 133 by fastening the jig fastening member 191.

The pulsator 160 is disposed to cover the fixing jig 190. The pulsator 160 together with the fixing jig 190 is accommodated in the second portion 133*b*2. The pulsator 160 preferably has a larger diameter than the fixing jig 190 so that the fixing jig 190 is not exposed to the outside.

In addition, the facing ends of the pulsator 160 and the tub base 133 may be disposed adjacent to each other at the same layer level. According to the above structure, the laundry can be prevented from being caught in a gap between the pulsator 160 and the tub base 133.

Figure 9:
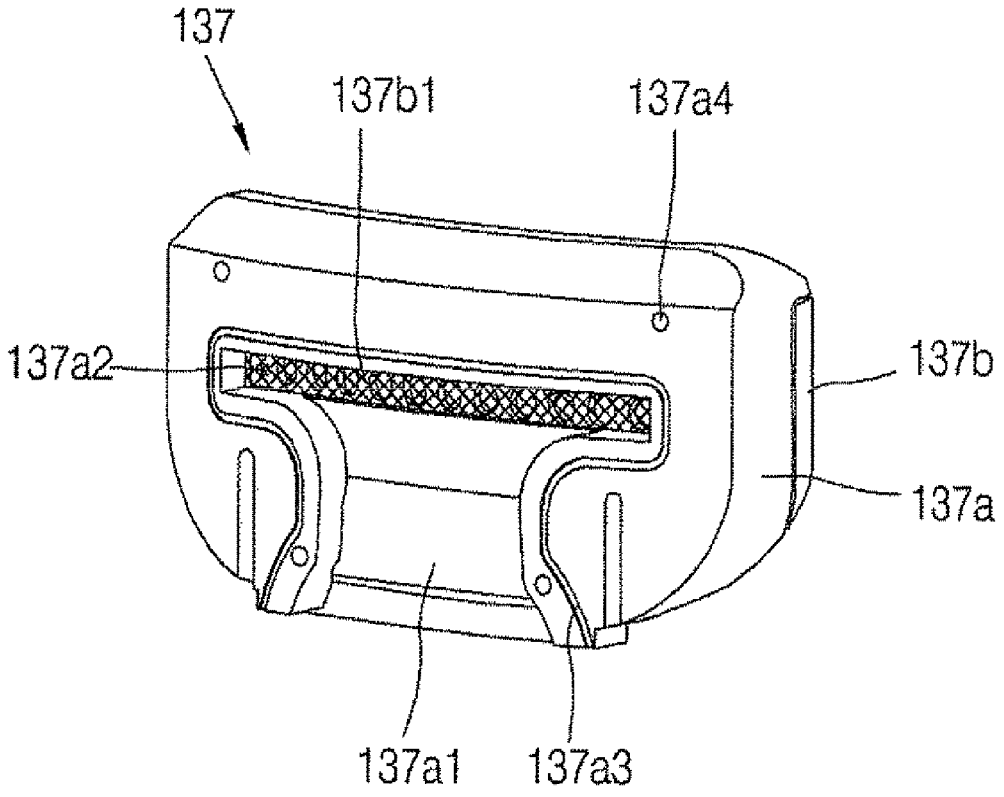
FIG. 9 is a perspective view showing a filter unit 137 shown in FIG. 3A and FIG. 3B.
Figure 10:
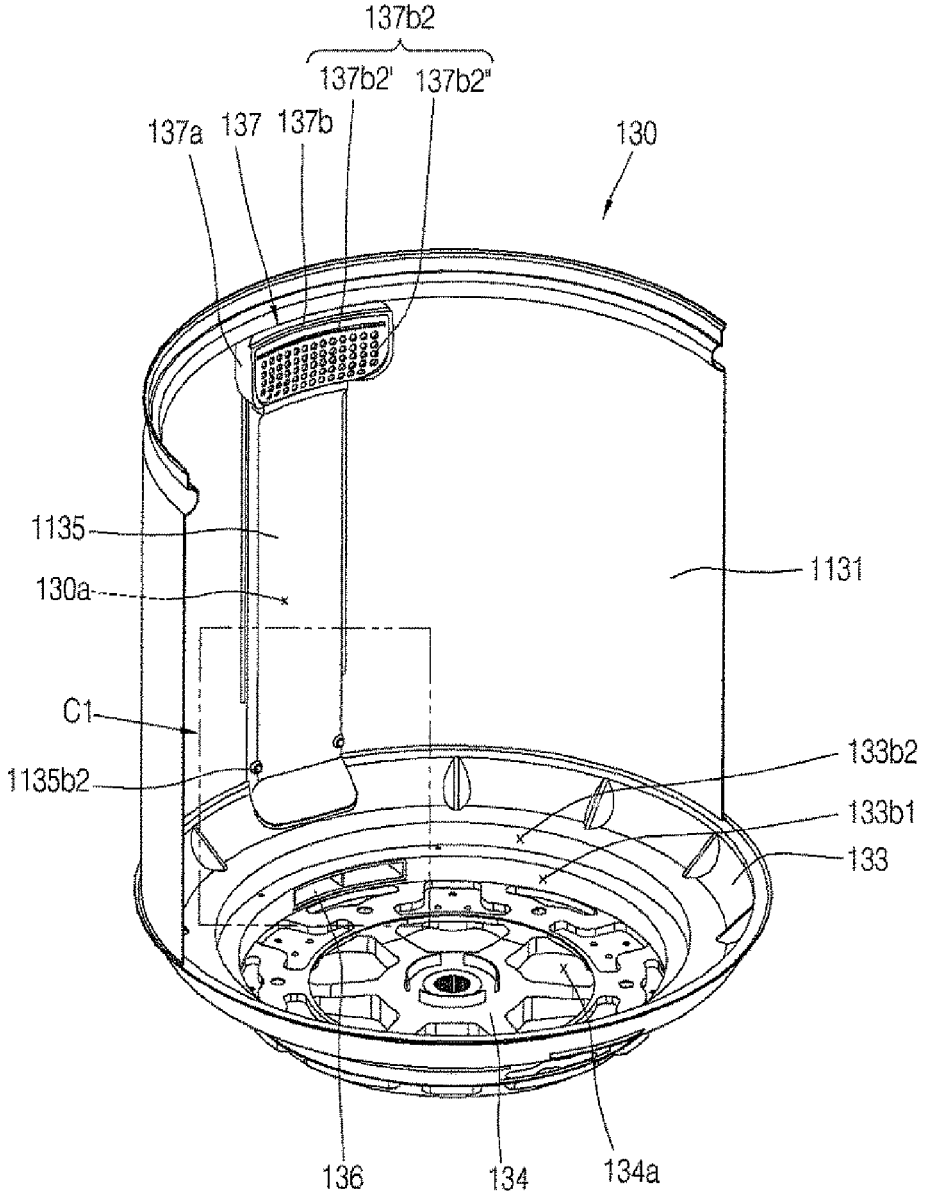
FIG. 10 is a cross-sectional view of the washing machine 100 according to the first embodiment shown in FIG. 2A, taken along line A1-A1'.
Figure 13:
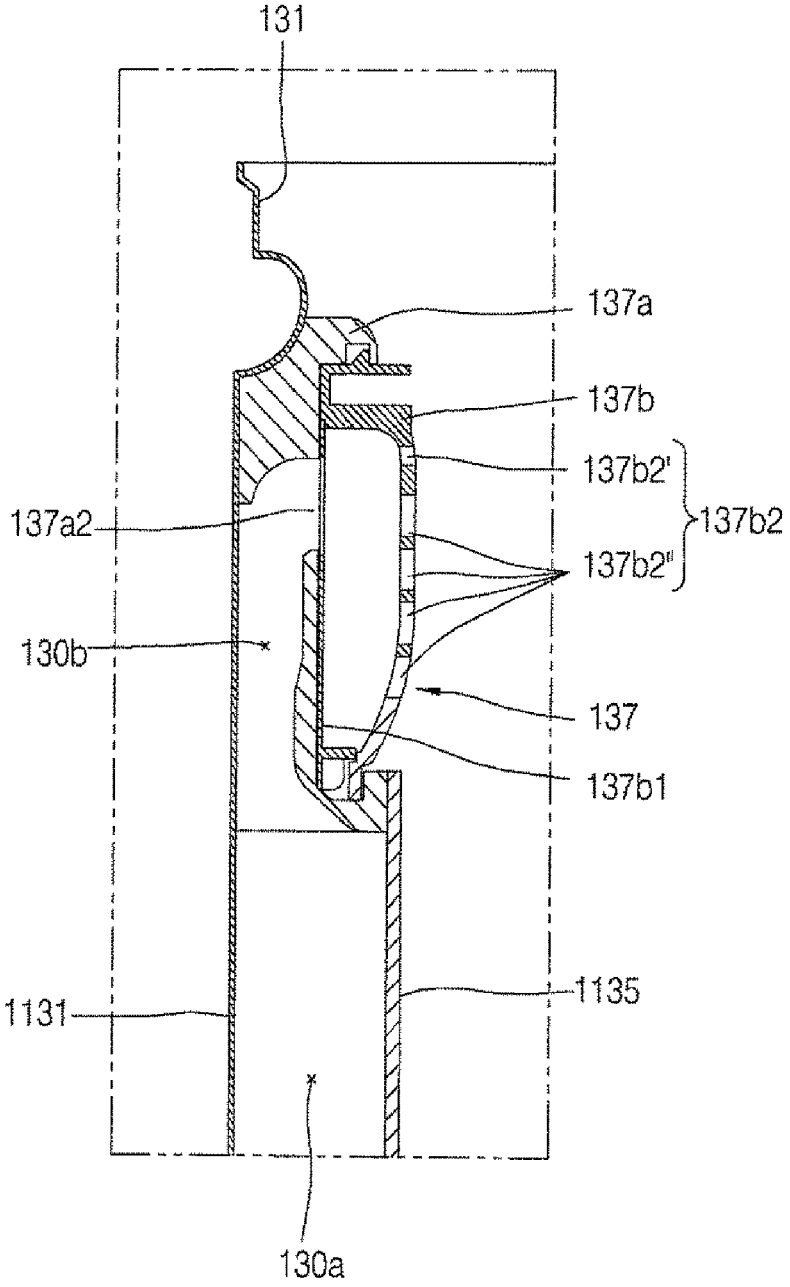
FIG. 13 is an enlarged perspective view of a portion D1 in FIG. 12.
Figure 20:
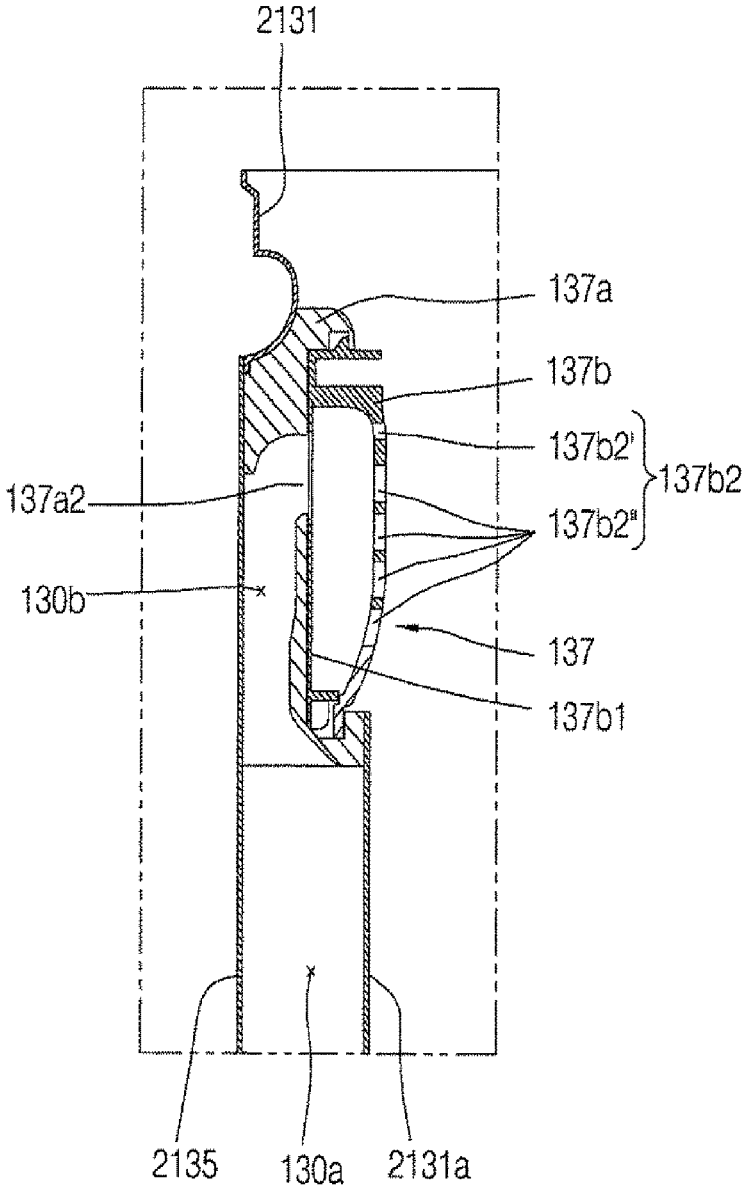
FIG. 20 is an enlarged perspective view of a portion D2 in FIG. 19.
Figure 21:
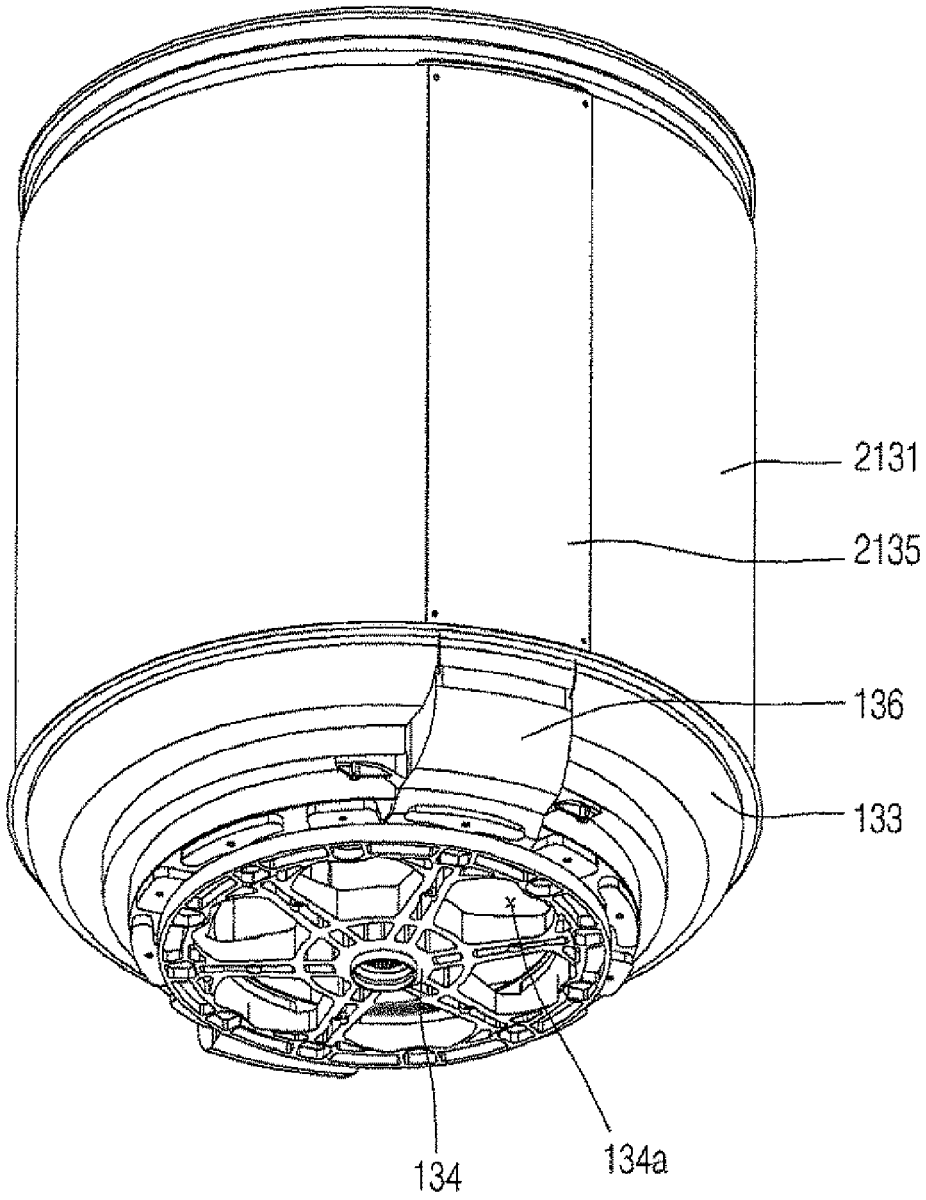
FIG. 21 is a perspective view of the washing machine 100 according to the second embodiment shown in FIG. 2B viewed from one side of a bottom.
Figure 22:
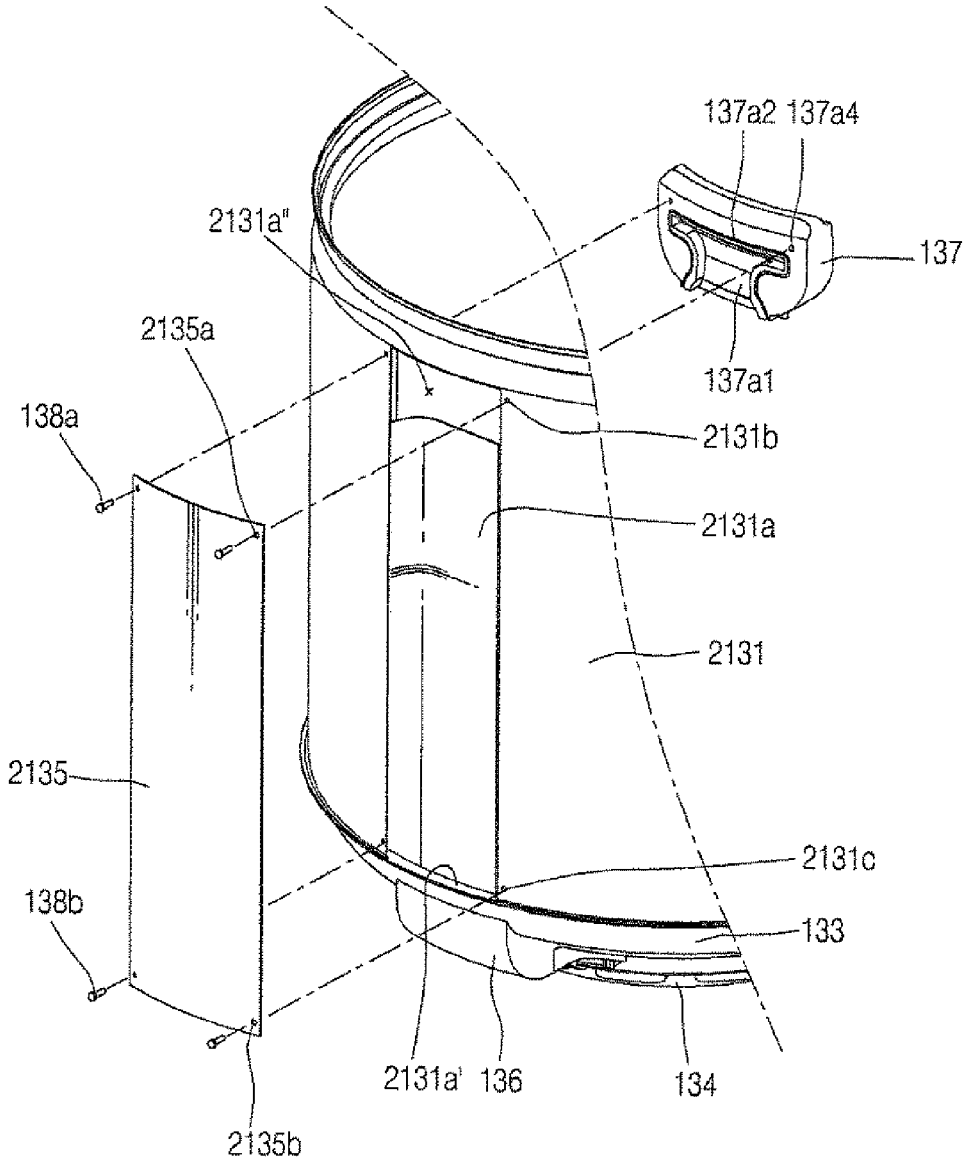
FIG. 22 to FIG. 26 are perspective views showing a process of coupling the filter unit 137 and the duct cover 2135 to the sidewall member 2131 of FIG. 21.
Figure 23:
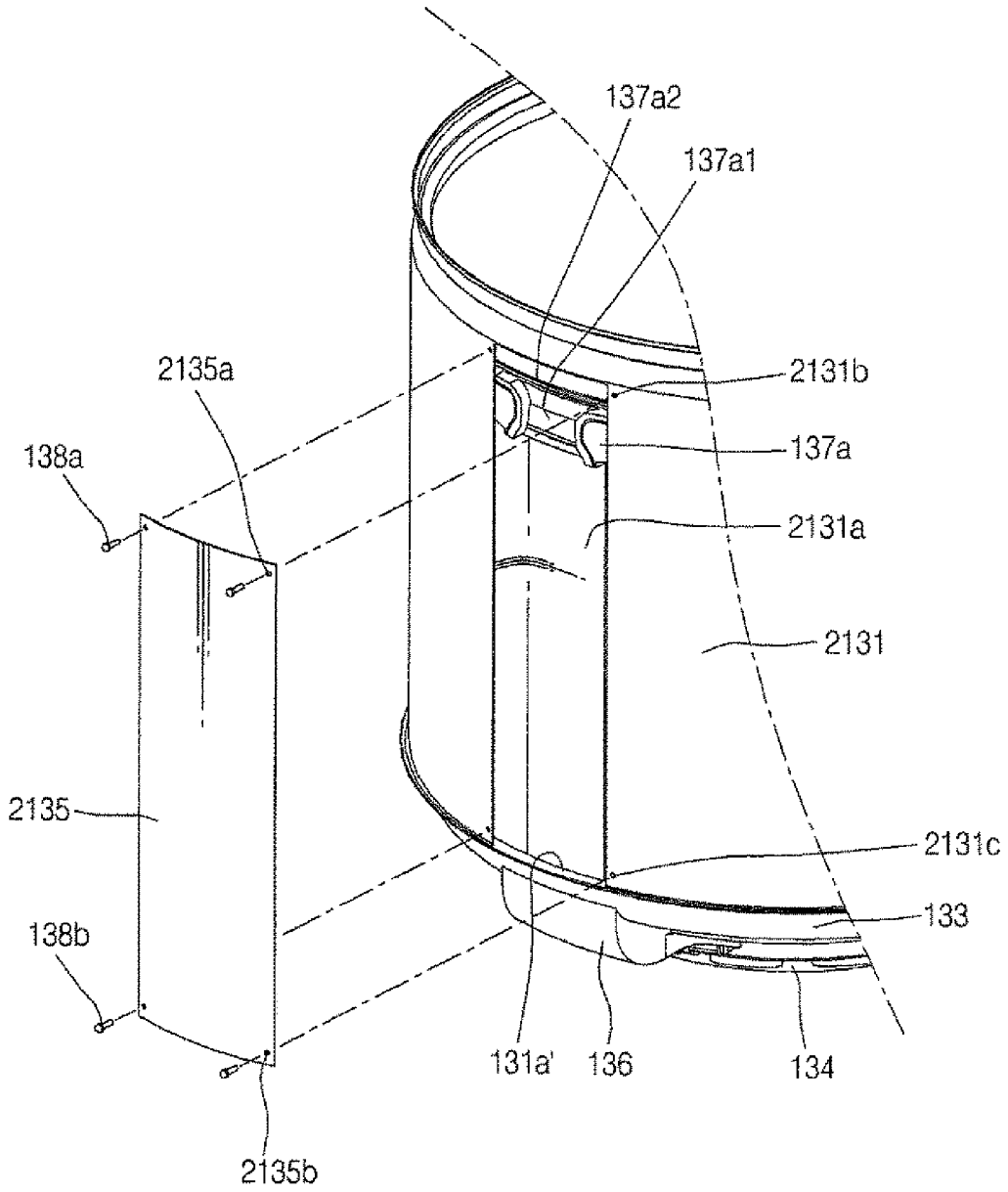
Figure 24:
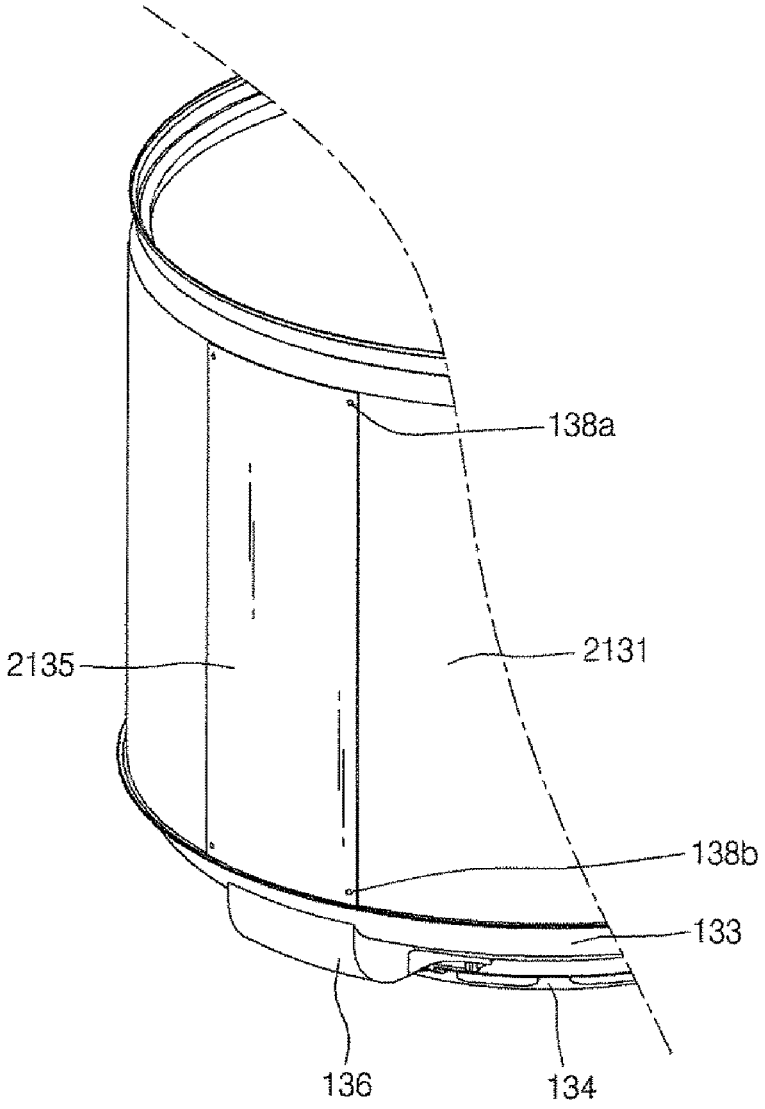

Referring to FIG. 9, FIG. 13, and FIG. 20, the filter unit 137 includes a filter housing 137*a* and a filter 137*b*.

The filter housing 137*a* is disposed at an upper end of the upward flow path 130*a*. The filter housing 137*a* has a communicating portion 137*a*1 and an opening portion 137*a*2. The communicating portion 137*a*1 is a recessed portion in the filter housing 137*a*.

In the first embodiment (see FIG. 13), the filter housing 137*a* is configured to be mounted in the sidewall member 1131, and communicate with an upper end of the duct cover 1135.

In the first embodiment, the communicating portion 137*a*1 communicates with the upper end of the duct cover 1135. The communicating portion 137*a*1 is disposed to cover the inner surface of the sidewall member 1131. The communicating portion 137*a*1 together with the inner surface of the sidewall member 1131 forms a washing water discharge path 130*b* communicating with the upward flow path 130*a* of the washing water.

In the first embodiment, a filter sealing member is interposed between the sidewall member 1131 and the filter housing 137*a*. The filter sealing member can prevent the washing water flowing through the washing water discharge path 130*b* from leaking. To this end, an accommodation groove 137*a*3 for mounting a filter sealing member (not shown) may be formed on the protrusion of the filter housing 137*a* so as to surround the communicating portion 137*a*1.

The end of the accommodation groove 137*a*3 formed in the filter housing 137*a* may be formed to correspond to the end of an accommodation groove 1135*b*3 formed in the duct cover 1135. In this case, the accommodation groove 1135*b*3 formed in the duct cover 1135 and the accommodation groove 137*a*3 formed in the filter housing 137*a* are continuously connected. Thus, the leakage of the washing water at the coupling portion between the duct cover 1135 and the filter housing 137*a* can be prevented. In addition, the filter sealing member and the duct cover sealing member may be integrally formed.

In a second embodiment (see FIG. 20), the filter housing 137*a* is mounted in the upper opening 2131*a*", and is configured to communicate with an outlet of the upward flow path 130*a* of washing water defined by a sidewall recess portion 2131*a* and the duct cover 2135.

In the second embodiment, the communicating portion 137*a*1 communicates with the upper opening 2131*a*" of the sidewall recess portion 2131*a*. The duct cover 2135 is disposed to cover the communicating portion 137*a*1. The duct cover 2135 together with the communicating portion 137*a*1 forms the washing water discharge path 130*b* communicated with the upward flow path 130*a* of the washing water.

In the second embodiment, the duct cover 2135 may be configured to be in close contact with the relatively protrusion around the recessed communicating portion 137*a*1. A filter sealing member (not shown) is interposed between the duct cover 2135 and the filter housing 137*a*. Accordingly, it is possible to prevent the washing water flowing through the washing water discharge path 130*b* from leaking. To this end, the accommodation groove 137*a*3 for mounting the filter sealing member may be formed on the protrusion of the filter housing 137*a* to surround the communicating portion 137*a*1.

In the first and second embodiments, the opening portion 137*a*2 communicates with the communicating portion 137*a*1, and is formed to open toward the inside of the sidewall member 1131, 2131. As shown in the drawing, the opening portion 137*a*2 may be formed to extend in one direction.

The filter 137*b* is mounted in the filter housing 137*a* to cover the opening portion 137*a*2. The filter 137*b* may be configured to be completely detachable with respect to the filter housing 137*a*. As an example, the upper end of the filter 137*b* is hooked to the filter housing 137*a* in a state where the lower end of the filter 137*b* is hooked to the filter housing 137*a* so that the filter 137*b* can be mounted in the filter housing 137*a*.

Alternatively, the filter 137*b* may be rotatably coupled to the filter housing 137*a*. For example, the lower end of the filter 137*b* may be hinged to the filter housing 137*a*, and the upper end of the filter 137*b* may be hooked to the filter housing 137*a*.

The filter 137*b* has a mesh filter 137*b*1 of network structure for filtering foreign matter. The mesh filter 137*b*1 is disposed to cover the opening portion 137*a*2 of the filter housing 137*a* so as to filter the foreign matter contained in the washing water introduced through the opening portion 137*a*2.

The filter 137*b* has discharge holes 137*b*2 for discharging washing water. The discharge holes 137*b*2 may be formed in a small hole shape, a long extended slit shape, or a combination thereof.

A slit-shaped discharge hole 137*b*2' is formed in the upper portion of the filter 137*b*. In addition, a small hole-shaped discharge holes 137*b*2" are formed below the discharge hole 137*b*2'. The washing water is sprayed over a wide area through the slit-shaped discharge hole 137*b*2'. The washing water is sprayed to various points through the small hole-shaped discharge holes 137*b*2", respectively, so that the cloth wetting can be performed in various ways.

The upper opening of the upward flow path 130*a* is disposed adjacent to the balancer 132. The filter unit 137 is disposed adjacent to the balancer 132. The filter unit 137 is positioned adjacent to the door 111 that opens and closes the upper opening of the inner tub 130.

With this arrangement, user can easily access the filter unit 137 without bending the waist too much. Therefore, the user can easily remove the foreign matter accumulated in the filter unit 137.

In addition, as the filter unit 137 is positioned in the upper portion of the inner tub 130, the washing water discharged through the filter unit 137 can fall down at a higher position. Therefore, the washing water can be discharged in a larger area in the sidewall member 1131, 2131, so that the cloth wetting effect can be improved.

Hereinafter, the first embodiment will be described in detail with reference to FIG. 10 to FIG. 16.

Hereinafter, according to the first embodiment, a flow path structure in which the washing water moved from a washing water inflow hole 1131' to the communication hole 133" in the outside of the tub base 133 by the guide member 136 can be moved toward the upper side of the sidewall member 1131 is illustrated.

Referring to the drawings, the duct cover 1135 extending along the height direction of the sidewall member 1131 is mounted on the inner side of the sidewall member 1131. An empty space extending upwardly is formed between the duct cover 1135 and the tub base 133 and between the duct cover 1135 and the sidewall member 1131, and the empty space forms an upward flow path 130*a* of washing water.

In the present embodiment, two duct covers 1135 are provided on the sidewall member 1131 so as to face each other. However, the present invention is not limited thereto. More than two duct covers 1135 may be provided depending on the design change.

Figure 11:
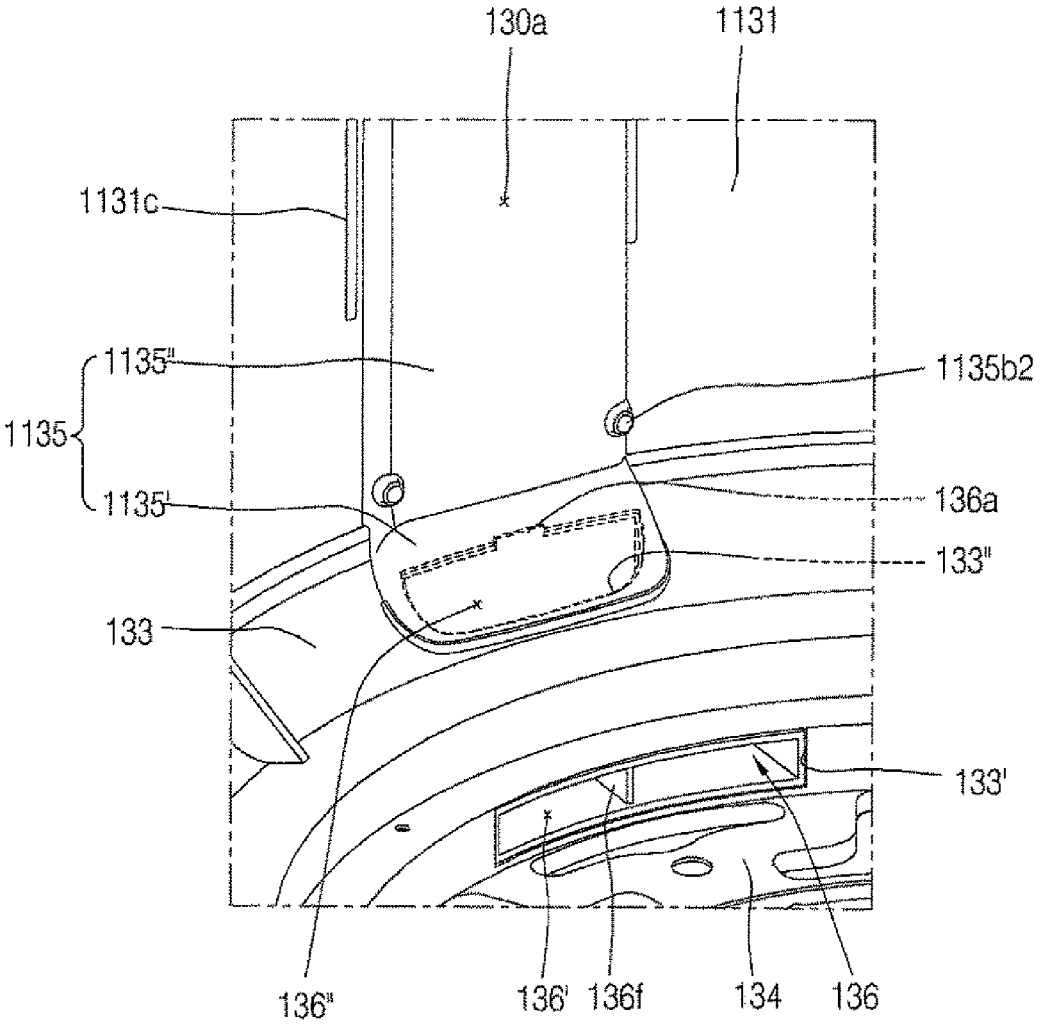
FIG. 11 is an enlarged perspective view of a portion C1 in FIG. 10.
Figure 12:
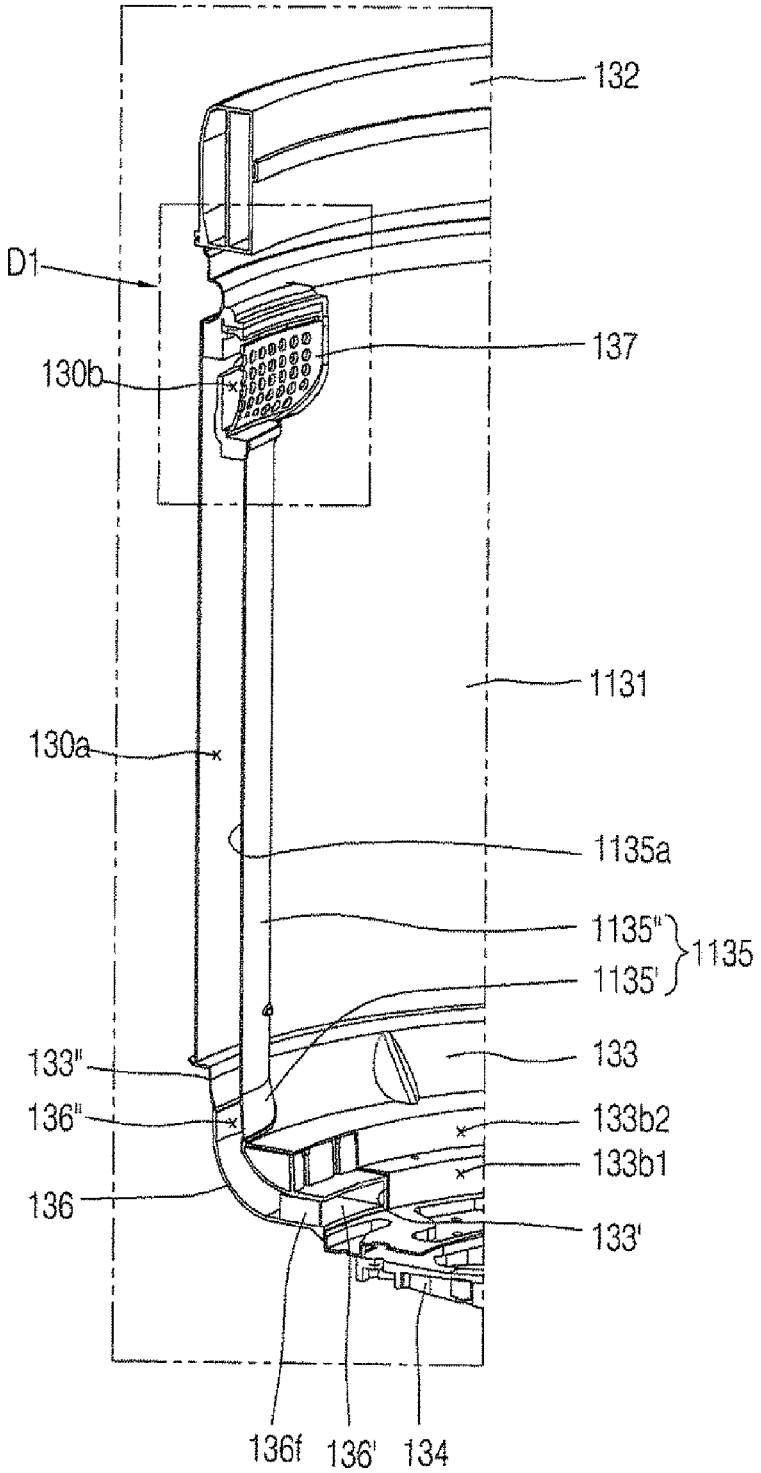
FIG. 12 is a sectional view of the washing machine 100 according to the first embodiment shown in FIG. 2A, taken along line B1-B1.

The duct cover 1135 is configured to communicate with the guide member 136 through the communication hole 133" so that the washing water introduced through the guide member 136 can be introduced into the upward flow path 130*a* of the washing water. To this end, as shown in FIG. 11, the lower end of the duct cover 1135 may be configured to cover the tub base 133 around the communication hole 133".

Hereinafter, the detailed structure of the duct cover 1135 and the fastening structure will be described.

The duct cover 1135 includes a first cover portion 1135' disposed to cover the upper surface of the tub base 133 and a second cover portion 1135" disposed to cover the inner surface of the sidewall member 1131. The first cover portion 1135' is disposed to enclose the communication hole 133" and the second cover portion 1135" is disposed to be inclined with respect to the first cover portion 1135'. A protruding rib (not shown) partially corresponding to the shape of the first cover portion 1135' may be formed on the upper surface of the tub base 133 to guide the installation position of the first cover portion 1135', and the end portion of the first cover portion 1135' may be in close contact with the protruding ribs.

The duct cover 1135 has a cover recess portion 1135*a* extending in the height direction. The cover recess portion 1135*a* is formed over the entire of first cover portion 1135' and the second cover portion 1135". The duct cover 1135 may have a '⊏'-shaped cross section by the cover recess portion 1135*a*.

The cover recess portion 1135*a* is disposed to face the upper surface of the tub base 133 and the inner surface of the sidewall member 1131 so that it forms the upward flow path 130*a* together with the upper surface of the tub base 133 and the inner surface of the sidewall member 1131. Accordingly, the washing water discharged through the communication hole 133" moves upward through the first cover portion 1135' and the second cover portion 1135". Here, the upward force of the washing water is caused by the pumping water generated by the rotation of the blade 150.

As described above, the washing water pumped by the blade 150 flows into the guide member 136 and moves from the washing water inflow hole 133' to the communication hole 133". At this time, the flow of the washing water is achieved in the outside the tub base 133. Thereafter, the washing water is moved to the upper side of the sidewall member through the washing water upward flow path 130*a*. At this time, the flow of the washing water is achieved inside of the tub base 133 and inside the sidewall member 1131. That is, it can be said that there is a singularity of the flow path in that the flow of the washing water changes from the outside of the tub base 133 to the inside.

As the cover recess portion 1135*a* is formed in the duct cover 1135, a rib portion 1135*b* relatively protruding are provided on both sides of the cover recess portion 1135*a*. The rib portion 1135*b* extends along the height direction of the duct cover 1135 to define the cover recess portion 1135*a*. When the duct cover 1135 is mounted in the sidewall member 1131, the rib portion 1135*b* may be configured to be brought into close contact with the inner surface of the sidewall member 1131.

The rib portion 1135*b* is provided with an engaging hook 1135*b*1 which can be engaged with an engagement hole 1131*a* of the sidewall member 1131. In the present embodiment (see FIGS. 14, 15 and 16), the engaging hook 1135*b*1 is formed to protrude from each of the rib portions 1135*b* provided in both sides of the cover recess portion 1135*a*.

The engaging hook 1135*b*1 may be configured to be engaged by being inserted into the engagement hole 1131*a* and then slid. In order to implement the engaging structure, the engaging hook 1135*b*1 may include a protrusion 1135*b*' protruding from the rib portion 1135*b* and an extension portion 1135*b*" extending downward from the protrusion 1135*b*'. That is, the engaging hook 1135*b*1 may have a bent shape of '¬'. The engagement hole 1131*a* formed in the sidewall member 1131 may be formed in a slot shape extending along the height direction of the sidewall member 1131.

With the above arrangement, the engaging hook 1135*b*1 is inserted into the engagement hole 1131*a* and then slid downward to engage with the engagement hole 1131*a*. In a state in which the engaging hook 1135*b*1 is engaged with the engagement hole 1131*a*, the extension portion 1135*b*1" may be disposed to cover the outer surface of the sidewall member 1131 and a protrusion 1135*b*1' may be engaged with the lower end of the engagement hole 1131*a*.

Figure 15:
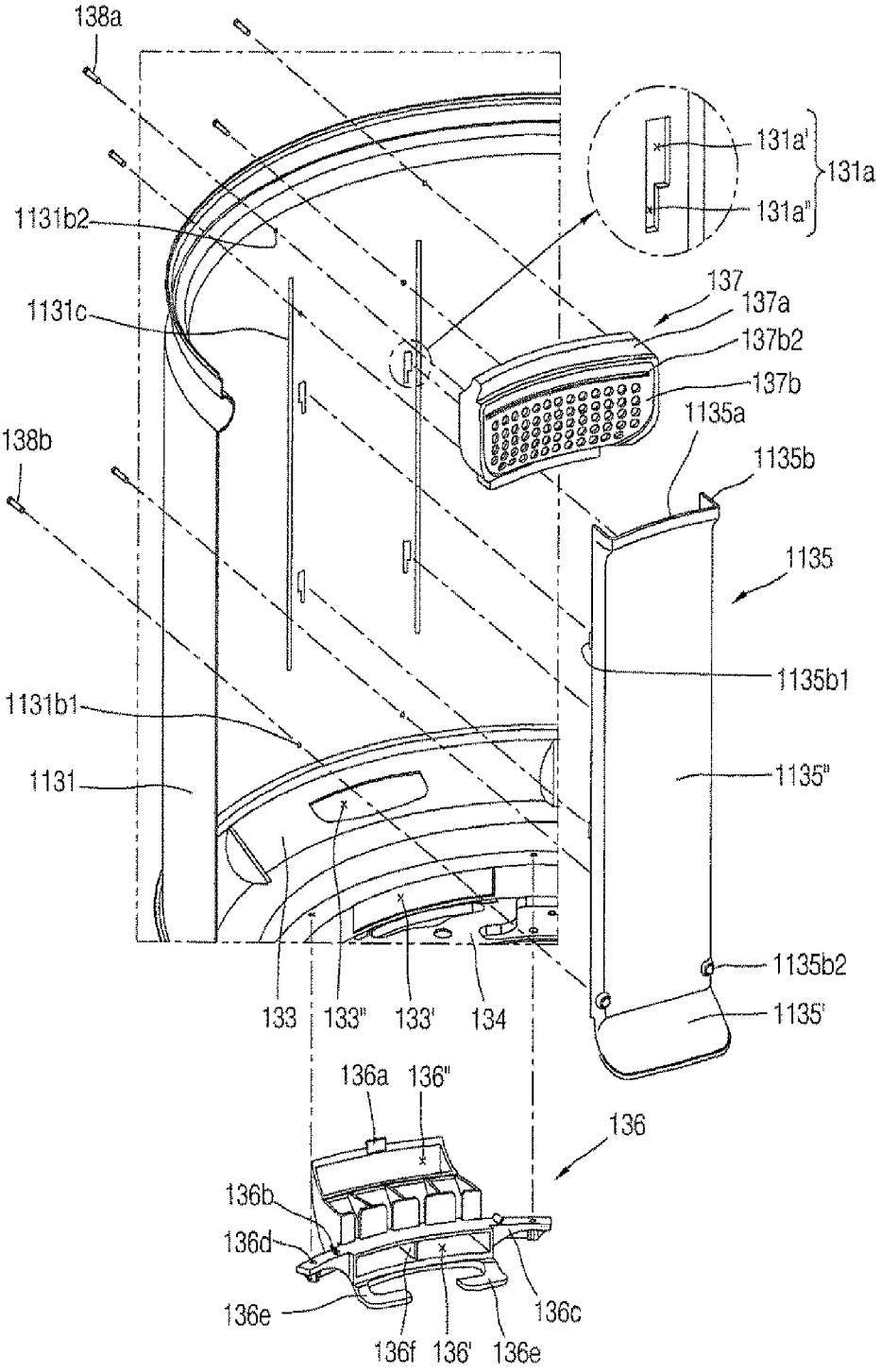
FIG. 15 is an exploded perspective view in which the guide member 136, a duct cover 1135, and the filter unit 137 are separated from a sidewall member 1131 shown in FIG. 10.

Here, as shown in FIG. 15, the upper portion 1131*a*' of the engagement hole 1131*a* is a portion into which the extending portion 1135*b*1" is inserted, and the width thereof may be firmed to be broader than the lower portion of the engagement hole 1131*a* with which the protrusion 1135*b*1' is engaged.

However, the shape of the engaging hook 1135*b*1 and the engagement hole 1131*a* and the corresponding engagement structure are not limited to the above-described example. The engaging hook 1135*b*1 may be configured to be fastened to the engagement hole 1131*a* by elastic deformation, and the coupling method of the duct cover 1135 for this purpose is not limited to the above-described insertion and slide moving method, but a direct coupling method, or the like can be used.

A guide rib 1131*c* for guiding the mounting of the duct cover 1131 may be protruded from the inner side of the sidewall member 1131. The guide rib 1131*c* may extend from the both sides of the duct cover 1135 along the height direction of the sidewall member 1131, thereby defining a mounting position of the duct cover 1135.

As described above, when the duct cover 1135 is fastened to the sidewall member 1131 in such a manner that the engaging hook 1135*b*1 is inserted into the engagement hole 1131*a* and then slid downward to engage with the engagement hole 1131*a*, the sliding movement of the duct cover 1131 can be guided by the guide rib 1131*c*.

The guide rib 1131*c* may be integrally formed with the sidewall member 1131. For example, the sidewall member 1131 may be press-formed so that the sidewall member 1131 having the guide rib 1131*c* can be manufactured. However, the present invention is not limited thereto. The guide rib 1131*c* may be configured to be separately attached to the inner surface of the sidewall member 1131.

The rib portion 1135*b* may be provided with a fastening portion 1135*b*2 to be fastened to a duct cover fastening member 138*b* passing through the sidewall member 1131. In the present embodiment, the duct cover fastening member 138*b* is screwed to the fastening portion 1135*b*2 while passing through the through hole 1131*b*1 formed in the lower portion of the sidewall member 1131.

The duct cover fastening member 138*b* may be configured to be fastened while being forcibly screwed to the fastening portion 1135*b*2. For this purpose, the fastening portion 1135*b*2 may be provided with a guide groove (not shown) provided with no thread to guide fastening of the duct cover fastening member 138*b*. According to the fastening structure, the duct cover fastening member 138*b* can be fixed without a nut, thereby facilitating assembly.

Obviously, the present invention is not limited to the fastening structure. The fastening portion 1135*b*2 may be integrally formed, by insert injection, with an insert nut having a threaded portion formed therein for fastening with the duct cover fastening member 138*b*.

The fastening portion 1135*b*2 may be formed to protrude from the outer surface of the duct cover 1131, in a structure of being fastened to the duct cover fastening member 138*b*. That is, the fastening portion 1135*b* is configured to independently protrude from the inside of the sidewall member 1131, and is preferably formed in a round shape so as not to damage the laundry.

In addition, the rib portion 1135*b* may be provided with an accommodating groove 1135*b*3 extending along both sides of the cover recess portion 1135*b*. The accommodating groove 1135*b*3 provides a space for seating the duct cover sealing member (not shown). With such a structure, when the duct cover 1135 is mounted in the sidewall member 1131, the duct cover sealing member is brought into close contact with the inner surface of the sidewall member 1131, thereby preventing leakage of the washing water flowing along the upward flow path 130*a* of the washing water.

The accommodation groove 1135*b*3 may be formed on the inner side or the outer side of the engaging hook 1135*b*1. In the present embodiment, it is exemplified that the accommodation groove 1135*b*3 is formed outside the engaging hook 1135*b*1.

The duct cover sealing member may be configured to be inserted into the accommodation groove 1135*b*3. In this case, the accommodation groove 1135*b*3 may be understood as an insertion groove. Alternatively, the duct cover sealing member may be configured to be filled in the accommodation groove 1135*b*3. In this case, the accommodation groove 1135*b*3 may be understood as a filling groove.

The filter unit 137 is mounted in the upper end of the duct cover 1135, i.e., in the upper end of the upward flow path 130*a* of the washing water. The filter unit 137 is configured to discharge the washing water that filtered foreign matter into the inside of the sidewall member 1131. The filter unit 137 may also be referred to as a discharge unit in that the washing water is discharged through the filter unit 137.

Hereinafter, the filter unit 137 and the discharge structure of the washing water through the filter unit 137 will be described in more detail.

Hereinafter, a structure in which the filter unit 137 is fixedly coupled to the sidewall member 1131 will be described.

Figure 14:
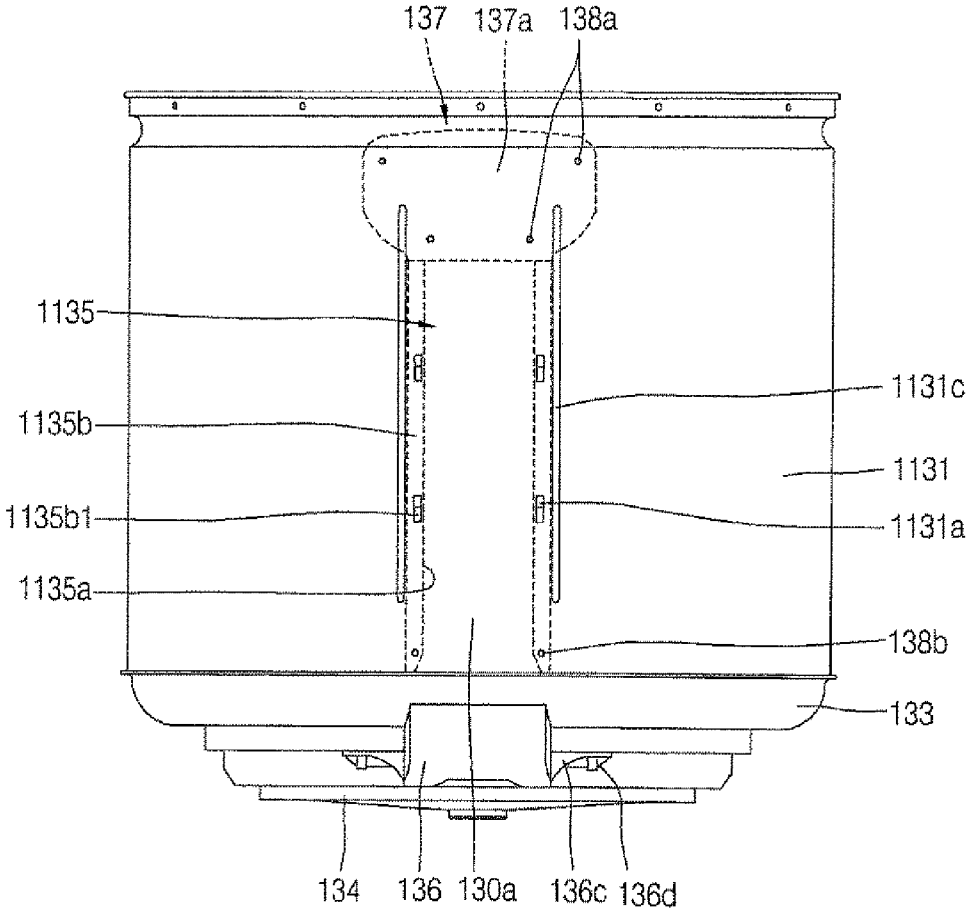
FIG. 14 is a side elevational view of the washing machine 100 according to the first embodiment shown in FIG. 2A.
Figure 16:
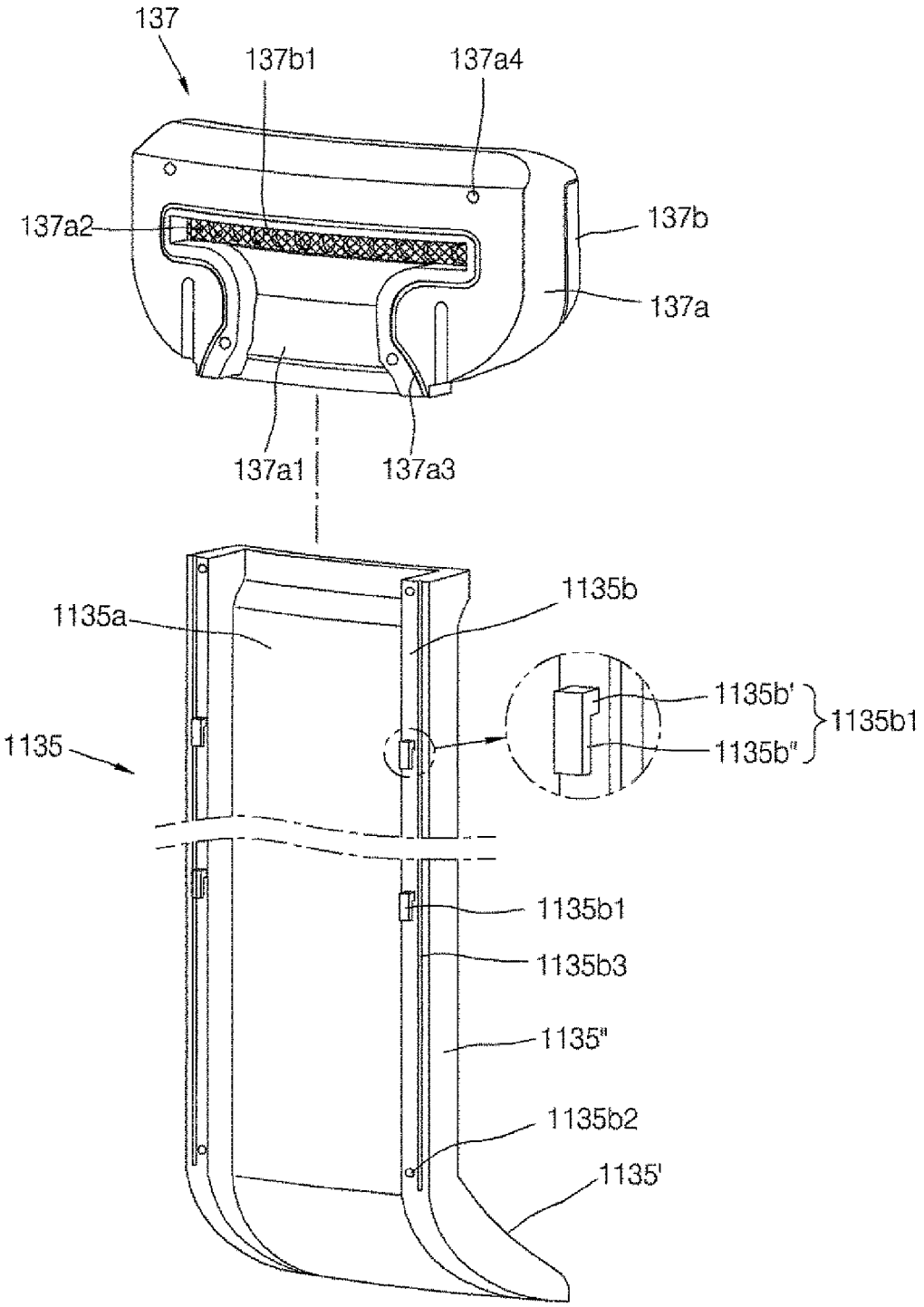
FIG. 16 is an exploded perspective view of the duct cover 1135 and the filter unit 137 of FIG. 10 viewed from a different angle.
Figure 17:
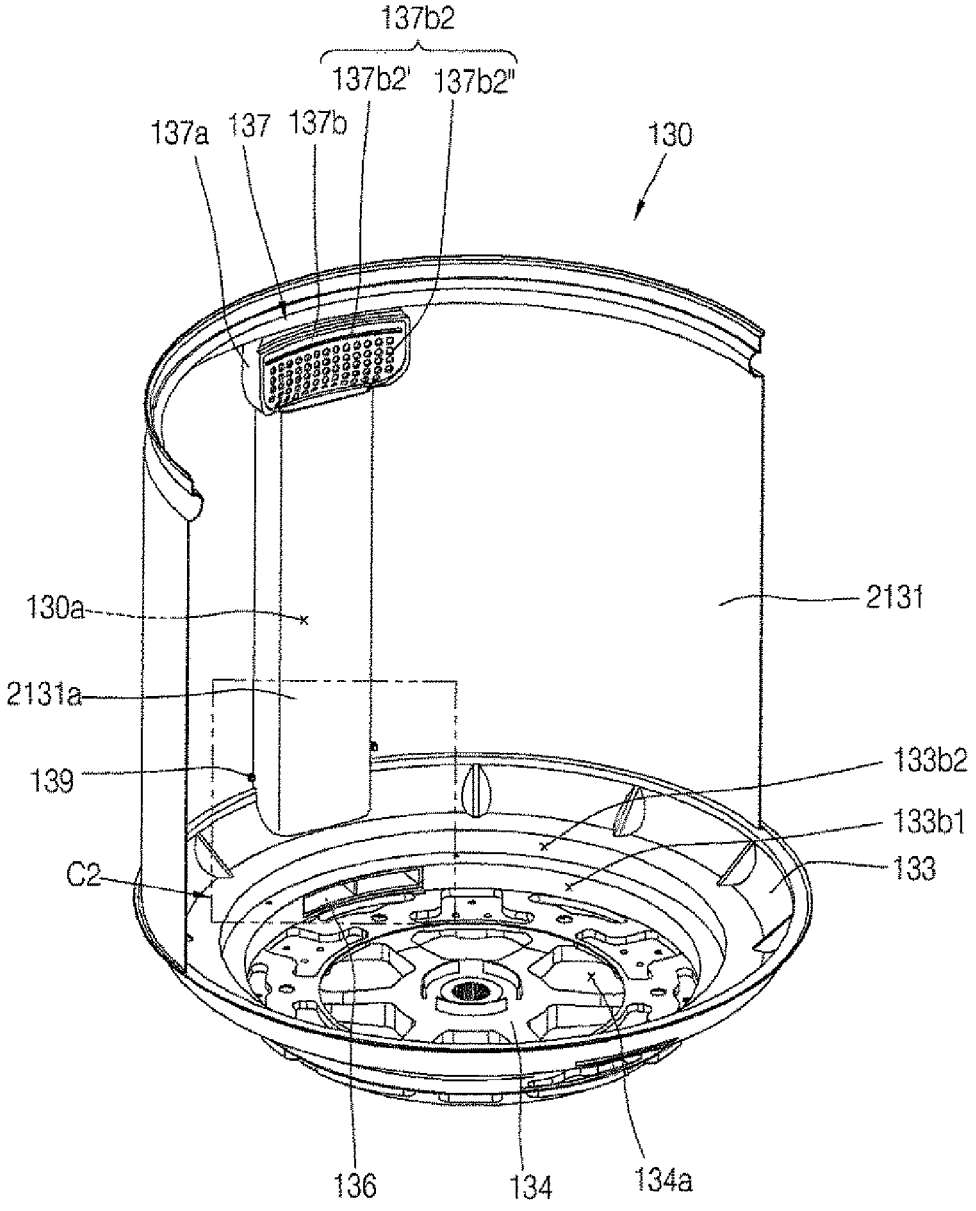
FIG. 17 is a cross-sectional view of the washing machine 100 according to the second embodiment shown in FIG. 2B taken along line A2-A2'.
Figure 18:
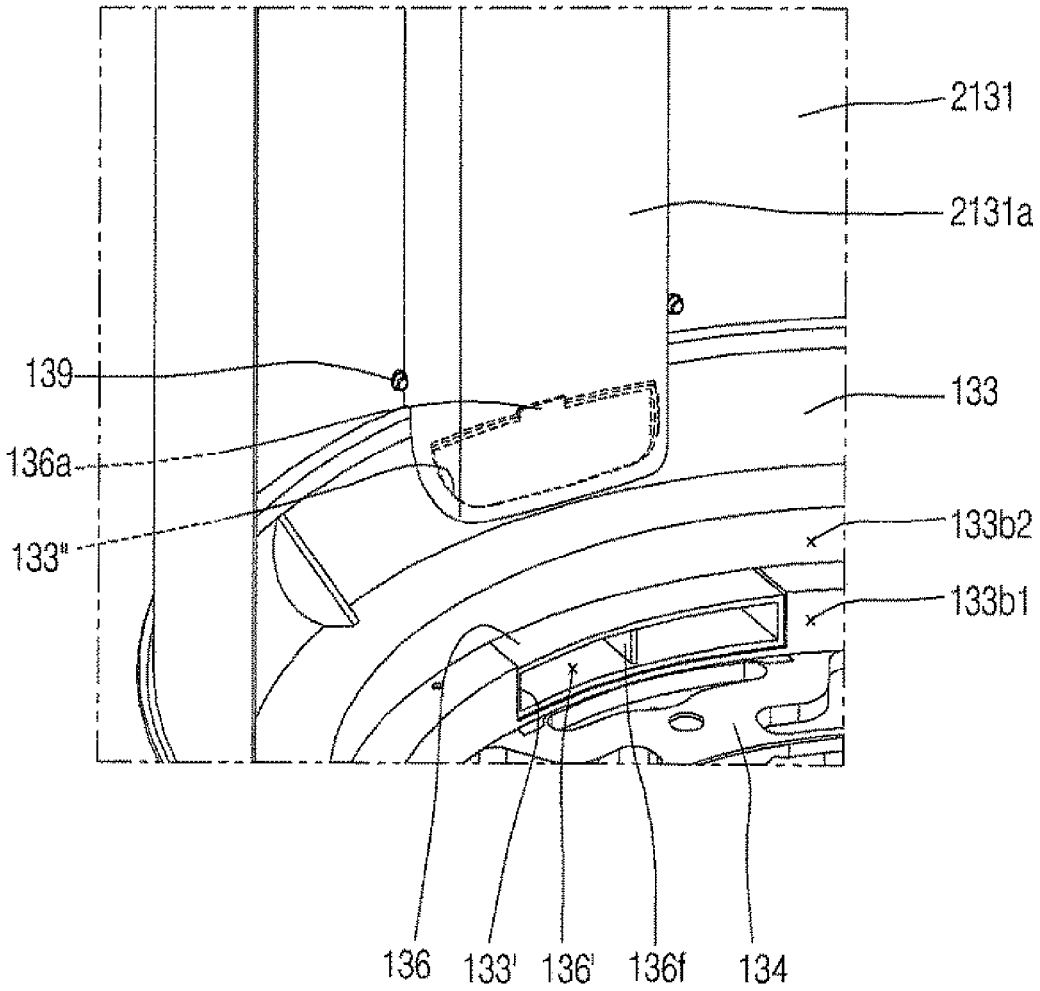
FIG. 18 is an enlarged perspective view of a portion C2 in FIG. 17.
Figure 19:
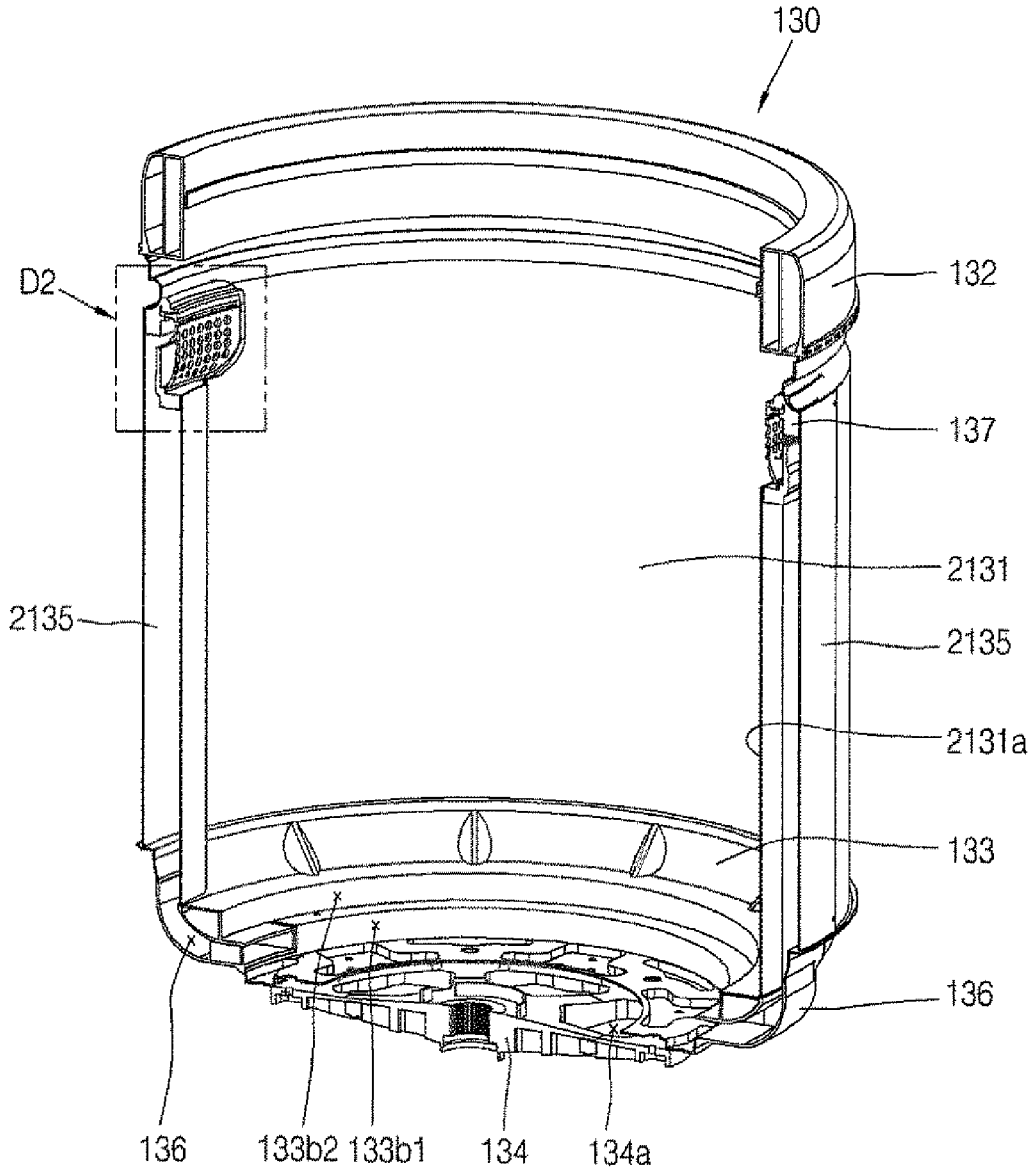
FIG. 19 is a cross-sectional view of the washing machine 100 according to the second embodiment shown in FIG. 2B taken along line B2-B2'.

Referring to FIG. 14, FIG. 15, and FIG. 16, the filter fastening member 138*a* passes through the sidewall member 1131 and is fastened to the filter housing 137*a*. In order to implement the above fastening structure, a through hole 1131*b*2 is formed in the sidewall member 1131 and a fastening groove 137*a*4 corresponding to the through hole 1131*b*2 is formed in the filter housing 137*a*. The filter fastening member 138*a* can be screwed into the fastening groove 137*a*4 while passing through the through hole 1131*b*2.

The engaging groove 137*a*4 is formed to have a diameter smaller than that of the filter engaging member 138*a* so that the filter engaging member 138*a* can be forcibly screwed and fastened to the engaging groove 137*a*4. According to the fastening structure, the filter fastening member 138*a* can be fixed without a nut, thereby facilitating assembly.

Obviously, the present invention is not limited to the fastening structure. The filter housing 137*a* may be integrally formed with an insert nut, by insert injection, having an internal thread formed therein for fastening with the filter fastening member 138*a*.

Hereinafter, a second embodiment will be described in detail with reference to FIGS. 17 to 26.

Referring to FIGS. 17 to 21, the sidewall member 2131 is provided with a sidewall recess portion 2131*a* having a recessed shape from the outside to the inside and extending in the height direction of the sidewall member 2131. That is, when the sidewall member 2131 is viewed from the outside, the sidewall recess portion 2131*a* is recessed inward, and the sidewall recess portion 2131*a* protrudes inward when viewed from the inside.

The sidewall recess portion 2131*a* may be formed by bending at least a part of the sidewall member 2131 by performing a forming process. For example the sidewall recess portion 2131*a* is formed on a metal plate through press working, and then both ends are joined by rolling up in a cylindrical form of a metal plate, so that the sidewall member 2131 can be manufactured.

In the present embodiment, it is illustrated that two sidewall recess portions 2131*a* are provided on the sidewall member 2131 to face each other. However, the present invention is not limited thereto. Two or more sidewall recess portions 2131*a* may be provided depending on the design change.

A duct cover 2135 is mounted on the outer side of the sidewall member 2131 so as to cover the recessed portion of the sidewall recess portion 2131*a* so that an upward flow path 130*a* of washing water is formed together with the recessed portion. That is, the inner space defined by the sidewall recess portion 2131*a* and the duct cover 2135 forms the upward flow path 130*a* of the washing water. Based on this structure, the washing water flows upward from the outside of the sidewall member 2131.

The duct cover 2135 may be formed in a round shape so as to correspond to the sidewall member 2131. As an example, the duct cover 2135 may have the same curvature as the sidewall member 2131. Thus, interference between the duct cover 2135 and the outer tub 120 can be prevented when the inner tub 130 rotates.

A duct sealing member (not shown) is interposed between the duct cover 2135 and the sidewall recess portion 2131*a* to prevent leakage of washing water flowing inside. To this end, the duct sealing member may extend along the height direction on both sides of the sidewall recess portion 2131*a*. On both sides of the sidewall recess portion 2131*a* or on the inner surface of the duct cover 2135, an accommodation groove (not shown) for accommodating the duct sealing member may be provided.

A lower opening 2131*a*' and an upper opening 2131*a*" are formed in the lower end and the upper end of the sidewall recess portion 2131*a*, respectively, and the washing water is introduced through the lower opening 2131*a*' and discharged through the upper opening 2131*a*". The lower opening 2131*a*' is disposed adjacent to the tub base 133, and the upper opening 2131*a*" is disposed adjacent to the balancer 132. Hereinafter, the inflow and outflow structure of the washing water through the lower opening 2131*a*' and the upper opening 2131*a*" will be described.

As described above, when the blade 150 is rotated, a water flow is made to move toward the washing water inflow hole 133', so that the washing water contained in the outer tub 120 is moved from the washing water inflow hole 133' to the communication hole 133" through the guide member 136. That is, the washing water flows to the outside of the tub base 133 by the guide member 136.

The lower opening 2131*a*' formed in the lower end of the sidewall recess portion 2131*a* is configured to communicate with the communication hole 133". In this drawing, the lower end of the sidewall recess portion 2131*a* is configured to cover the tub base 133 around the communication hole 133". The lower end of the sidewall recess portion 2131*a* may be formed to be in close contact with the tub base 133 to surround the communication hole 133".

The washing water introduced to the sidewall recess portion 2131*a* is moved to the upper portion of the sidewall member 2131 through the upward flow path 130*a* of the washing water which is an internal space defined by the sidewall recess portion 2131*a* and the duct cover 2135. The upward force of the washing water is caused by the pumping water flow generated by the rotation of the blade 150.

The filter unit 137 is mounted in the upper opening 2131*a*" of the sidewall recess portion 2131*a*. The filter unit 137 is configured to discharge the filtered washing water into the inside of the sidewall member 2131. The filter unit 137 may also be referred to as a discharge unit in that the washing water is discharged through the filter unit 137.

Hereinafter, a process of coupling the internal configurations of the washing machine 100 for forming the upward flow path 130*a* of the washing water and the washing water discharge path 130*b* will be described with reference to FIGS. 22 to 26.

Referring to these drawings, the filter unit 137 is mounted inside the sidewall member 2131, and the duct cover 2135 is mounted outside the sidewall member 2131.

The filter unit 137 is mounted in the upper opening 2131*a*" of the sidewall recess portion 2131*a*. The communicating portion 137*a*1 of the filter housing 137*a* described above is exposed to the outside through the upper opening 2131*a*" and communicates with the sidewall recess portion 2131*a* to form a continuous flow path through which washing water can be moved. That is, the upward flow path 130*a* of the washing water and the washing water discharge path 130*b* are connected to each other.

The duct cover 2135 is mounted in the sidewall member 2131 so as to cover the filter unit 137 mounted in the upper opening 2131*a*" of the sidewall recess portion 2131*a*. As shown in the drawing, the duct cover 2135 extends upward from the lower end of the sidewall member 2131. With the above structure, the duct cover 2135 together with the recessed portion of the sidewall recess portion 2131*a* forms the upward flow path 130*a* of the washing water and forms the discharge flow path 130*b* for washing water together with the communicating portion 137*a*1 of the filter housing 137*a*.

Hereinafter, a structure in which the duct cover 2135 is fixedly coupled to the sidewall member 2131 will be described.

Figure 25:
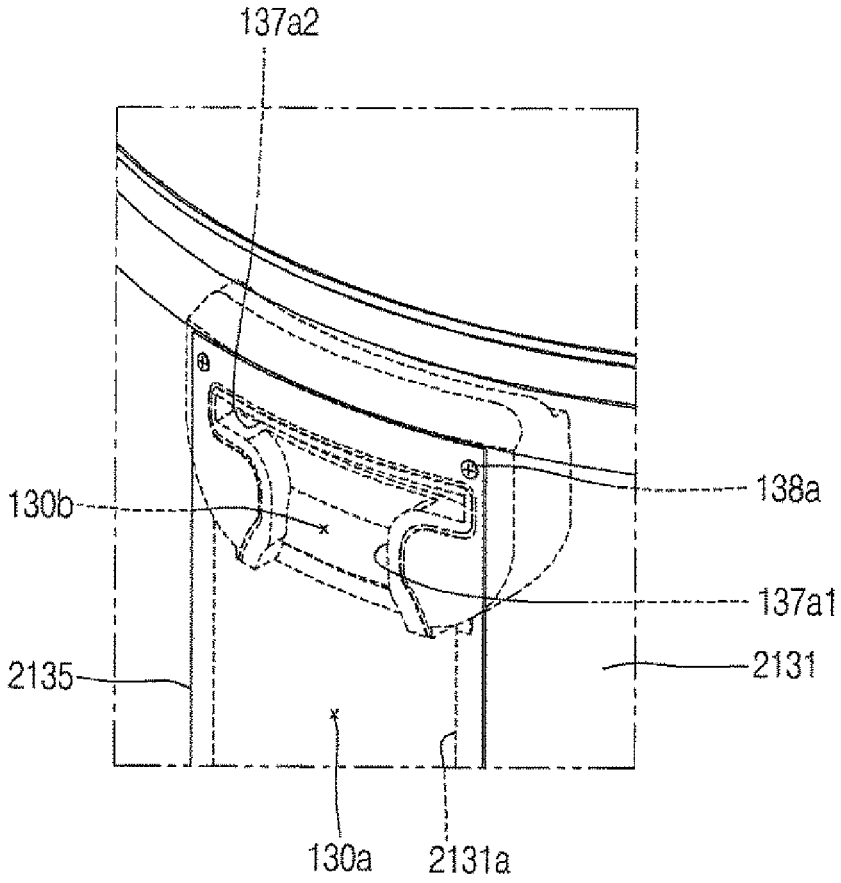

Referring to FIG. 25 with the preceding drawings, the duct cover 2135, the sidewall member 2131, and the filter housing 137*a* are disposed on the upper side of the sidewall member 2131 to be overlapped with each other in the thickness direction of the sidewall member 2131. The filter fastening member 138*a* passes though the duct cover 2135 and the sidewall member 2131 and is fastened to the filter housing 137*a*. By fastening the filter fastening member 138*a*, the duct cover 2135 and the filter housing 137*a* can be fixed to the sidewall member 2131 at one time.

To implement the fastening structure, the through hole 2131*b* is formed in both sides of the upper opening 2131*a*" of the sidewall recess portion 2131*a*, the insert holes 2135*a* corresponding to the through hole 2131*b* is formed in both sides of the duct cover 2135, and the fastening groove 137*a*4 corresponding to the through hole 2131*b* is formed in both sides of the filter housing 137*a*, respectively. The filter fastening member 138*a* can pass through the insertion hole 2135*a* and the through hole 2131*b* sequentially and can be screwed into the fastening groove 137*a*4.

The fastening groove 137*a*4 is formed to have a diameter smaller than that of the filter fastening member 138*a* so that the filter fastening member 138*a* can be forcibly screwed and fastened to the fastening groove 137*a*4. According to the fastening structure, the filter fastening member 138*a* can be fixed without a nut, thereby facilitating assembly.

Obviously, the present invention is not limited to the fastening structure. The filter housing 137*a* may be integrally formed, by the insert injection, with an insert nut having an internal thread formed therein for fastening with the filter fastening member 138*a*.

Figure 26:
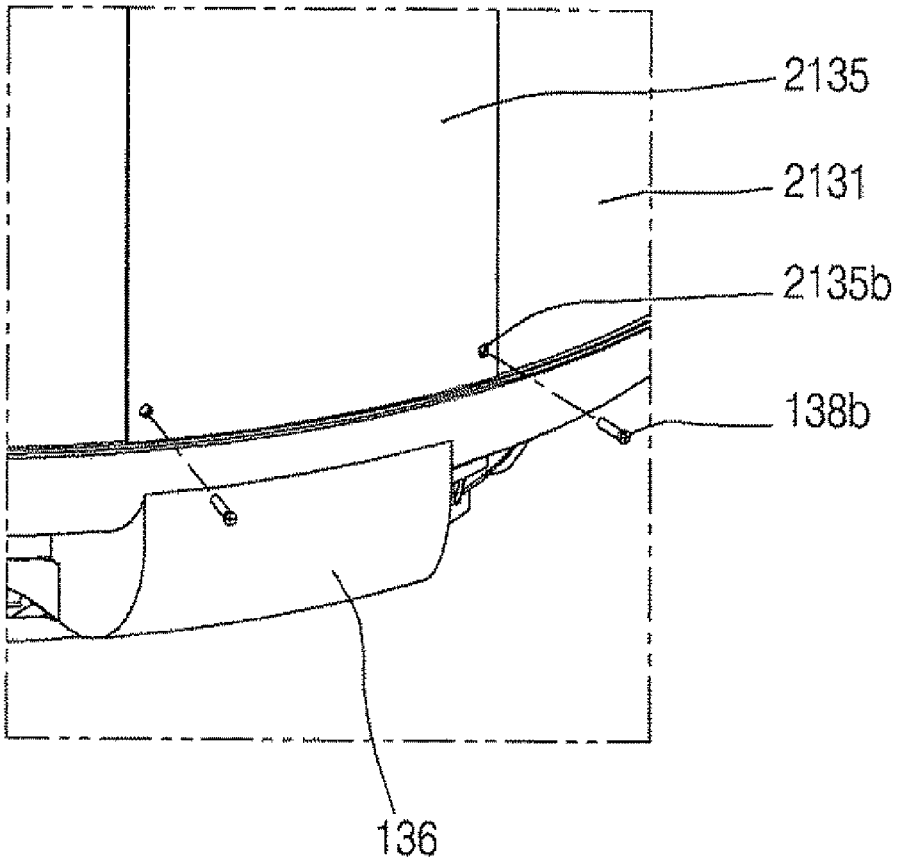

Referring to FIG. 26 with the preceding drawings, the through holes 2131*c* are formed in both sides of the lower opening 2131*a*' of the sidewall recess portion 2131*a* respectively, and the insert holes 2135*b* corresponding to the through hole 2131*c* are formed in both sides of the duct cover 2135, respectively. In addition, a fixing member 139 corresponding to each of the through hole 2131*c* is provided in the inner side of the sidewall member 2131.

The fixing member 139 is configured to be screwed to the duct fastening member 138*b* which sequentially penetrates the insertion hole 2135*b* and the through hole 2131*c*. That is, it can be understood that the fixing member 139 serves as a nut for fixing the duct fastening member 138*b*.

The duct fastening member 138*b* may be forcibly screwed and fastened to the fixing member 139. According to the fastening structure, the duct fastening member 138*b* can be fixed without a nut, thereby facilitating assembly.

Obviously, the present invention is not limited to the fastening structure. The fastening member 139 may be integrally formed with an insert nut, by insert injection, having an internal thread formed therein for fastening with the duct fastening member 138*b*.

The fixing member 139 may be formed of a synthetic resin material. Since the fixing member 139 is provided inside the sidewall member 2131, it is preferable that the fixing member 139 is formed in a round shape so as not to damage the laundry. In addition, since the fixing member 139 is provided in both sides of the sidewall recess portion 2131*a* protruding inward of the sidewall member 2131, the fixing member 139 is positioned in a relatively recessed portion, so that a large amount of contact with the laundry cannot be achieved structurally.

The invention claimed is:

1. A washing machine comprising:

an outer tub disposed inside a cabinet and configured to receive washing water;

an inner tub rotatably installed inside the outer tub and configured to accommodate laundry therein, the inner tub comprising a sidewall member;

a tub base coupled to a lower end of the sidewall member, the tub base defining a washing water inflow hole and a communication hole that are spaced apart from each other in a height direction;

a pulsator rotatably provided in the tub base and configured to generate a water flow of washing water during rotation;

a blade rotatably provided in a lower portion of the pulsator and configured to generate a pumping water flow for transferring washing water to the washing water inflow hole during rotation;

a guide member coupled to a bottom surface of the tub base and disposed at an outside of the tub base, the guide member defining:

a washing water inlet port configured to communicate with the washing water inflow hole, and a washing water outlet port spaced apart from the washing water inlet port and configured to communicate with the communication hole; and a duct cover disposed at the sidewall member, wherein the sidewall member and the duct cover define an upward flow path of washing water between the sidewall member and the duct cover, the upward flow path extending in the height direction along the sidewall member and being configured to communicate with the guide member through the communication hole, and wherein the guide member comprises a partition wall that partitions the washing water inlet port, that extends from the washing water inlet port toward the washing water outlet port, and that is configured to guide washing water from the washing water inlet port toward the washing water outlet port.

2. The washing machine of claim 1, wherein the guide member is disposed to cover the bottom surface of the tub base.

3. The washing machine of claim 1, wherein the guide member comprises an engaging hook configured to engage with the communication hole.

4. The washing machine of claim 1, wherein the tub base comprises a protruding portion disposed at the bottom surface of the tub base, and wherein the guide member comprises a surround portion configured to surround the protruding portion.

5. The washing machine of claim 4, further comprising a hub that defines a water inflow hole and that is coupled to the bottom surface of the tub base to cover a part of the surround portion.

6. The washing machine of claim 1, further comprising a filter unit that communicates with an upper end of the upward flow path and that discharges filtered washing water into an inside of the sidewall member.

7. The washing machine of claim 6, wherein the filter unit comprises:

a filter housing that is mounted in an upper opening to communicate with the upward flow path and has an opening portion opened toward the inside of the sidewall member; and a filter that is mounted in the filter housing to cover the opening portion and that includes a mesh filter for filtering foreign matter contained in the washing water, the filter defining discharge holes for discharging the filtered washing water.

8. The washing machine of claim 7, wherein the sidewall member defines a sidewall recess portion that is recessed from an outside of the sidewall member to the inside of the sidewall member along the height direction, and wherein the duct cover is mounted at the outside of the sidewall member, and covers the filter housing mounted at the upper opening.

9. The washing machine of claim 1, wherein the duct cover is mounted in an inner side of the sidewall member.

10. The washing machine of claim 1, wherein the duct cover comprises:

a cover recess portion that extends along the height direction and is disposed to cover an upper surface of the tub base and an inner surface of the sidewall member; and a rib portion that extends along both sides of the cover recess portion, and defines the cover recess portion.

11. The washing machine of claim 10, wherein the rib portion comprises an engaging hook configured to engage with an engagement hole defined at the sidewall member.

12. The washing machine of claim 1, wherein the sidewall member comprises a guide rib that is disposed at both sides of the duct cover, that extends in the height direction along the sidewall member and that protrudes from an inside of the sidewall member.

13. The washing machine of claim 1, wherein the sidewall member defines a sidewall recess portion that is recessed from an outside of the sidewall to an inside of the sidewall member along the height direction, and wherein the duct cover is mounted at the outside of the sidewall member and configured to cover the sidewall recessed portion, the upward flow path including the sidewall recessed portion.

14. The washing machine of claim 13, wherein the sidewall recess portion is formed in a shape in that at least a part of the sidewall member is bent by forming.

15. The washing machine of claim 14, wherein the sidewall recess portion is protruded to the inside of the sidewall member.

16. The washing machine of claim 13, wherein the duct cover is formed in a round shape to correspond to the sidewall member.

17. The washing machine of claim 13, wherein a lower end of the sidewall recess portion covers an upper surface of the tub base around the communication hole.

18. The washing machine of claim 1, wherein the partition wall extends radially outward from a position within the washing water inlet port, and partitions an inner space of the guide member into a plurality of spaces that are arranged along a circumferential direction of the tub base.

19. The washing machine of claim 18, wherein the partition wall extends radially outward from a center position within the washing water inlet port, and wherein circumferential widths of the plurality of spaces are equal to each other.

* * * * *